US006038967A

United States Patent [19]

Chak et al.

[11] Patent Number: 6,038,967

[45] Date of Patent: Mar. 21, 2000

[54] STRAPPING MACHINE HAVING PRIMARY AND SECONDARY TENSIONING UNITS AND A CONTROL SYSTEM THEREFOR

[75] Inventors: Yee C. Chak, Hoquiam; Bryan R. Dierick, Montesano; Gary L. Hylton, Hoquiam, all of Wash.

[73] Assignee: Ovalstrapping, Inc., Hoquiam, Wash.

[21] Appl. No.: 09/150,491

[22] Filed: Sep. 9, 1998

Related U.S. Application Data

[62] Division of application No. 08/751,875, Nov. 18, 1996, Pat. No. 5,809,873.

[51] Int. Cl.[7] ..... B65B 13/22; B65B 13/06

[52] U.S. Cl. ..... 100/2; 53/64; 53/399; 53/589; 100/4; 100/26; 100/29

[58] Field of Search ..... 100/2, 4, 26, 29, 100/32, 33 PB; 53/64, 399, 589

[56] References Cited

U.S. PATENT DOCUMENTS

| | | | |
|---|---|---|---|
| 3,232,217 | 2/1966 | Harmon et al. | 100/4 |
| 3,420,158 | 1/1969 | Kobiella | 100/2 |
| 3,447,448 | 6/1969 | Pasic . | |
| 3,884,139 | 5/1975 | Pasic . | |
| 3,946,921 | 3/1976 | Noguchi | 100/26 |
| 4,120,239 | 10/1978 | Pasic et al. . | |
| 4,201,127 | 5/1980 | Pasic . | |
| 4,312,266 | 1/1982 | Pasic . | |
| 4,387,631 | 6/1983 | Pasic . | |
| 4,435,945 | 3/1984 | Rohrig | 100/33 PB |
| 4,473,005 | 9/1984 | Pasic . | |
| 4,516,488 | 5/1985 | Bartzick et al. . | |
| 4,595,433 | 6/1986 | Ford et al. | 100/33 PB |
| 4,712,357 | 12/1987 | Crawford et al. . | |
| 4,955,180 | 9/1990 | Sakaki et al. . | |
| 5,146,847 | 9/1992 | Lyon et al. . | |
| 5,187,656 | 2/1993 | Kurakake . | |
| 5,218,813 | 6/1993 | Seidel . | |
| 5,287,802 | 2/1994 | Pearson . | |
| 5,333,438 | 8/1994 | Gurak et al. | 100/26 |
| 5,412,845 | 5/1995 | Ueding et al. . | |
| 5,560,187 | 10/1996 | Nagashima et al. . | |
| 5,590,694 | 1/1997 | Naito et al. | 100/29 |

FOREIGN PATENT DOCUMENTS

| | | |
|---|---|---|
| 0 695 687 | 2/1996 | European Pat. Off. . |
| 2615480 | 11/1988 | France . |
| 3841 884 A1 | 6/1990 | Germany . |
| 287152 | 2/1991 | Germany . |
| 4421 430 | 1/1996 | Germany . |
| 4421 661 | 1/1996 | Germany . |
| 8-11816 | 1/1996 | Japan . |
| 8-11818 | 1/1996 | Japan . |
| 2226 427 | 6/1990 | United Kingdom . |
| 95/10452 | 4/1995 | WIPO . |

*Primary Examiner*—Stephen F. Gerrity
*Attorney, Agent, or Firm*—Seed Intellectual Property Law Group PLLC

[57] ABSTRACT

A strapping machine and method for applying flexible heat-sealable straps around objects includes a programmable control system that receives encoder and other signals from various sensors in the machine to regulate each strapping cycle. A feed/tension unit provides primary tensioning of the strap about the object based on signals from the control system. A motor driven roller and a pinch roller in the feed/tension unit each providing separate encoder signals to the control system to assist the control system in advancing and retracting the strap during feed and tensioning sequences, respectively, and provide signals indicating an exact position of the strap. A secondary tension system provides a final high tensioning force on the strap. The control system can automatically adjust individual strapping cycles, including tensioning, to compensate for various size bundles and different types of objects. Thereafter, a sealing head heat seals the strap and severs the sealed strap from the remaining strap coil. The control system can selectively disengage the secondary tensioning during individual strapping cycles for objects that could be damaged or deformed during such high tensioning.

30 Claims, 26 Drawing Sheets

STRAPPING MACHINE HAVING PRIMARY AND SECONDARY TENSIONING UNITS AND A CONTROL SYSTEM THEREFOR

CROSS-REFERENCE TO RELATED APPLICATION

This application is a divisional of U.S. patent application Ser. No. 08/751,975, filed Nov. 18, 1996 (now U.S. Pat. No. 5,809,873).

TECHNICAL FIELD

The present invention relates to machines that use flexible, fusible straps of various types for containment or strapping purposes. Typical applications include, but are not limited to, the strapping of magazines, newspapers, boxes, trays, etc.

BACKGROUND OF THE INVENTION

Many high-speed, automatic strapping machines have been developed, such as those disclosed in U.S. Pat. Nos. 3,735,555; 3,884,139; 4,120,239;, 4,312,266; 4,196,663; 4,201,127; 3,447,448; 4,387,631; and 4,473,005. As disclosed by the devices in these patents, a conveyor belt typically conveys a bundle at high speed to a strapping station where straps are automatically applied before the conveyor belt moves the strap bundle away from the device. Current machines are able to strap approximately 40 to 50 bundles per minute. However, it is desirable to further increase the speed of such strapping devices to thereby provide enhanced throughput.

Typical strapping machines employ an initial or primary tensioning apparatus that provides an initial tensioning of the strap about the bundle. A secondary tensioning apparatus thereafter provides increased or enhanced tension of the strap. Thereafter, a sealing unit or head seals the strap, typically through the use of a heated knife mechanism, to complete the bundling operation.

Prior strapping devices relied exclusively on mechanical assemblies, such as multiple cam and follower mechanisms, piston driven linkages, etc. for timing. Such mechanical mechanisms can provide quite rapid strapping of certain bundles. However, if bundles of various sizes, and consisting of various types of material, are to be bundled, such mechanical strapping devices can excel in strapping, only one size bundle objects, while poorly strapping another size bundle or a bundle of different objects. Such mechanical, or electromechanical, machines are unable to automatically adjust for differing size bundles or bundles of different objects that are rapidly sent to the machine. Additionally, such mechanical devices may be unable to effectively bundle objects at speeds in excess of 60 bundles per minute. Importantly, both the primary and secondary tensioning devices are unable to reliably operate at such high speeds.

In general, the strapping machines currently on the market use traditional electromechanical components such as clutches, brakes, V-belts, etc. for power transmission. The widespread use of servo controls in other industries, however, now makes their use in strapping machines an economically and technically viable alternative to these traditional electromechanical devices.

Traditional servo drive architecture, however, typically involves the use of a PLC (programmable logic controller) platform and so called "smart" servo drive cards to drive the servo motors. Unfortunately, this architecture imposes significant delays in the control program which are not acceptable at high speeds. The PLC based system essentially operates in a master/slave relationship with a main central processing unit ("CPU") issuing a command to the drive card and the drive card executing the command, no real time link between the CPU and the card is provided. Without a real time link, the control system is inflexible and the CPU does not have complete control over the move routines sent to the servo motors.

SUMMARY OF THE INVENTION

The present invention improves upon prior strapping devices, and provides additional benefits, by employing a control system or machine controller that performs the control functions of a programmable controller in addition to providing servo drive controls. Using variables in the control system, the banding and sealing cycle can be easily altered to fit various production and package requirements.

The present strapping machine employs servo motors for use with the sealing head and feed/tension roller drives. Servo motors and drives provide precise control of position, velocity and acceleration, while reducing maintenance issues associated with traditional drive components such as clutches, brakes, V-belts, etc. In order to provide real time CPU control over the servo functions, the control system employs a processor such as the Intel 80C196NP processor. The control system also includes servo motor circuits and I/O circuits to control machine functions.

A feed/tension system of the present strapping machine employs closed loop control. By comparing signals output from a feed/tension encoder with pinch roller proximity sensor data, the relative slip between pinch and drive rollers can be detected. This data is used in two modes: (1) a feed mode to detect short feeds where the strap fails to thread its way through the track; and (2) a tension mode to detect when primary tensioning of the strap about a bundle is complete.

In the feed mode, the feed/tension servo motor feeds the strap through a track for a predetermined number of encoder pulses. During the feeding operation, the encoder pulses are continually compared against the pinch roller proximity sensor pulses. A significant variation in this position tracking indicates slippage between the drive and pinch rollers indicating a short feed condition. When a short feed condition is detected, the strap is retracted to the strap sensor lever area where a "retry" sequence resets the encoder and proximity sensor data. The feed sequence can again be attempted several times as determined by the control system.

In the primary tension mode, the feed/tension servo motor retracts the strap for either a predetermined number of encoder pulses in a loop size control mode for predetermined bundle sizes, or to a point where the tension drive roller begins to slip on the strap. When strapping highly compressible packages, the control system can alter the sealing head speed to allow more time for the drive roller to fully tension the strap.

The present strapping machine also employs closed loop mechanical secondary tension initiated by a bundle height sensor or operator input. By tracking the sealing head and feed/tension pinch roller positions, the mechanical secondary tension sequence can be initiated at the appropriate time in the strapping cycle. The secondary tension system preferably is cam driven based on a secondary tensioning cam positioned coaxially with the remaining cams of the system on a common drive shaft. The control system can monitor the position of the strap under primary tension, and speed, or slow, the rotation of the common shaft, so that secondary tensioning is applied at the appropriate time.

These and other benefits of the present invention will become apparent to those skilled in the art based on the following detailed description.

DETAILED DESCRIPTION OF THE INVENTION

A machine for manipulating flexible tape-type material, and in particular, an apparatus and method for providing primary and secondary tensioning in a strapping machine, is described in detail herein. In the following description, numerous specific details are set forth such as specific components, arrangement and coupling of such components, etc., in order to provide a thorough understanding of the present invention. One skilled in the relevant art, however, will readily recognize that aspects of the present invention can be practiced without certain specific details, or with other components, coupling elements, etc. In other instances, well-known structures are not described in detail in order to avoid obscuring the present invention.

Figure 1:
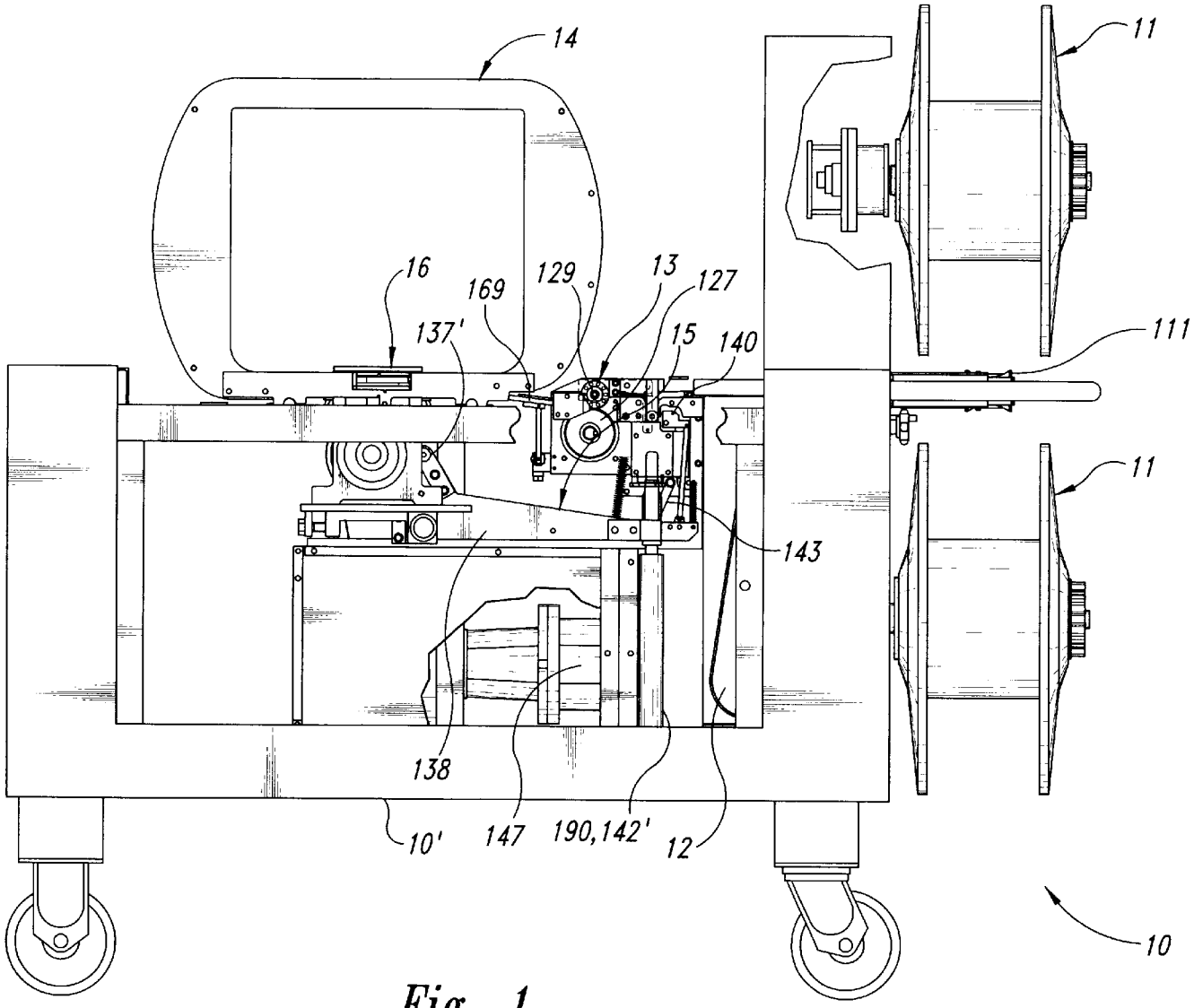
FIG. 1 is a front elevational view and partial fragmentary view of a strapping machine embodying the present invention.

Referring to FIG. 1, a strapping system or machine 10 comprises the following major components, all mounted to a housing or frame 10': a dispenser unit 11, an accumulator unit 12, a feed and tension unit 13, a track unit 14, a secondary tension unit 15, a sealing head unit 16, and a control system 200. The basic operation of the machine involves paying off strap from a strap coil mounted on the dispenser 11 and feeding the free strap end through the accumulator 12, feed and tension unit 13, sealing head 16 and track 14. After the strap has been fed around the track 14 and back into the sealing head 16 the strapping cycle can begin. The strapping cycle is controlled by a series of sealing head cams performing the strap application functions in a single rotation of a common shaft and cams of the sealing head 16, as described in more detail below.

The overall operation of the system 10 will first be described, and thereafter, the individual components will be described in detail. The strapping cycle begins with a right hand gripper 148 (FIG. 9C) gripping the free end of the strap against a cover slide 153 (FIG. 9C). A track guide 132 is mechanically opened and the strap is pulled from the track guide 132 (FIG. 8B) as the strap is drawn around the package by a feed/tension motor 126 (FIG. 5) in the primary tensioning sequence.

As this primary tensioning process is completed, the sealing head 16 continues to rotate and additional strap tension is applied by the secondary tension unit 15. As the secondary tensioning process is completed, a left hand gripper 149 (FIG. 9C) grips the supply side of the strap against the cover slide 153. The overlapping strap sections are pressed together by a press platen 152, heated by a heater blade 150 and severed from the supply by a strap cutter 154 (all shown in FIG. 9C). Next, the heater blade is withdrawn from the strap seal area. The sealing head 16 continues to rotate allowing the press platen 152 to press and seal the overlapping strap sections.

During the sealing cycle, the strap path through the sealing head 16 is once again aligned and the feeding sequence can begin. The sealing head 16 continues to rotate allowing the seal to cool while the feeding sequence continues. At the end of the strapping cycle, the cover slide 153 opens, the sealed strap is released and the cover slide returns to the closed position. The strap continues to feed until the free end reaches the sealing head 16 once again. After the feed sequence has been completed, the machine is then ready to apply another strap.

Two operational modes are available: (1) manual, and (2) automatic. The manual mode allows straps to be applied by the operator primarily for off line strapping operations and maintenance testing. In the automatic mode, the machine is mated to upstream infeed equipment such as conveyors and the strapping cycle is initiated by a package sensor (not shown) located on the entry side of the system 10, which provides an upstream interlock signal indicating a package is being delivered to the system to initiate a strapping cycle.

Strap Dispenser Unit

Figure 2A:
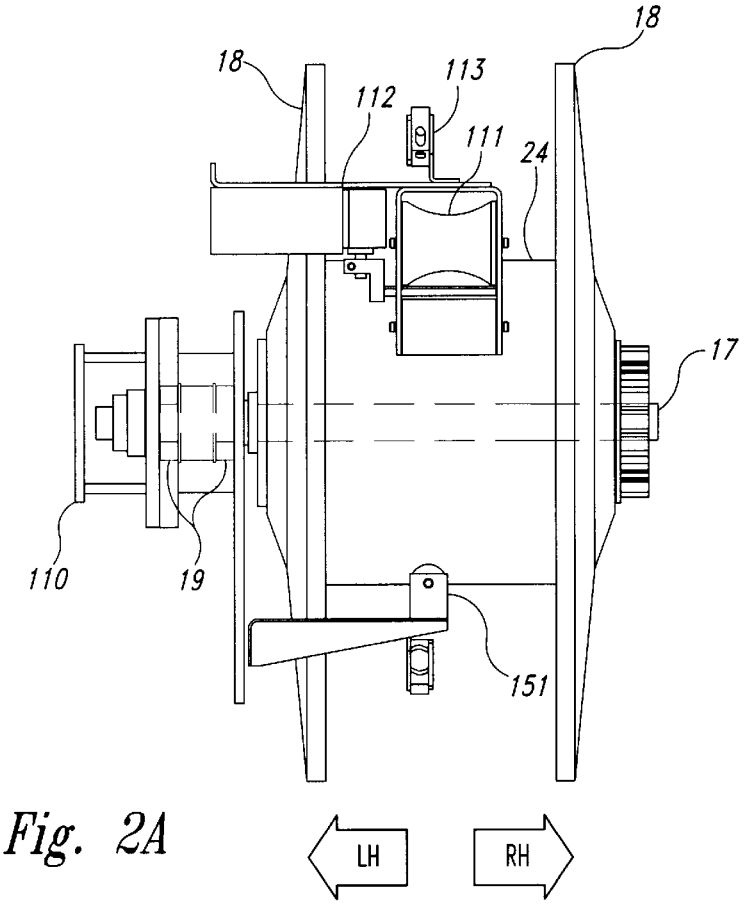
FIG. 2A is a top plan view of a strap dispenser for use by the strapping device of FIG. 1.
Figure 2B:
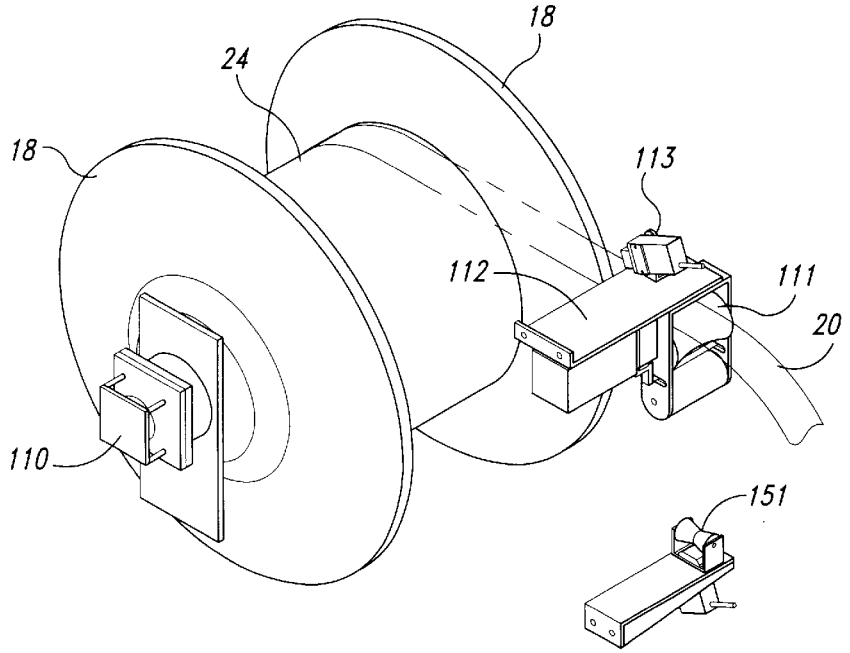
FIG. 2B is a top front isometric view of a strap dispenser for use by the strapping device of FIG. 1.
Figure 3:
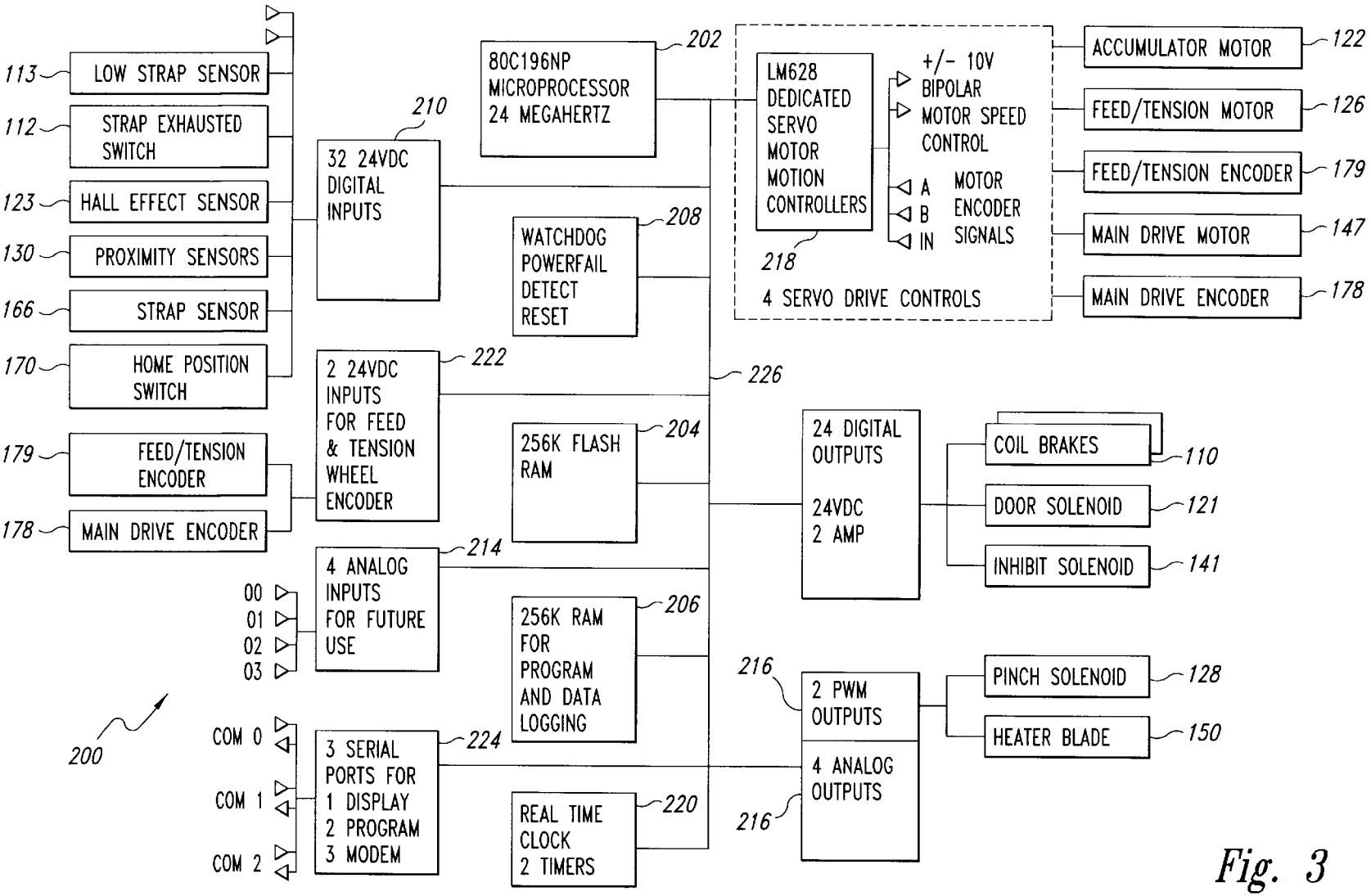
FIG. 3 is a block diagram of a control system for use by the strapping device of FIG. 1.

Referring to FIGS. 2A and 2B, the dispenser 11 provides a mounting means for the coils of strapping material 20 (shown in broken lines) necessary for the strapping operation. The strapping system 10 preferably employs two dispensers 11, only one of which is shown in FIGS. 2A and 2B. The dispenser essentially comprises a shaft 17, with removable, axially mounted outer side plates 18, tangentially positioned strap exhausted switch 112, a non-contact low strap sensor 113 and guide rollers 111 and 151, and an axially mounted dispenser coil brake 110. The shaft is rotatably mounted onto the strapping system 10, proximate to the accumulator 12, by means of bearings 19, while the strap exhausted switch 112, coil brake 110 and non-contact low strap sensor 113 are electrically coupled to one of several inputs of the control system 200, as shown in FIG. 3. Based on brake release signals supplied from the control system to the coil brake 110, the rotation of the bearing 19 mounted dispenser shaft 17 is controlled by the electrically operated brake, which is released by the control system as strap is demanded by the machine. The dispenser brake 110 is preferably a conventional spring actuated type that is engaged in the absence of an electrical signal. The control system releases the brake each time an accumulator motor 122 (FIG. 4A) is energized to fill a depleted accumulator 12 section. When the control system 200 de-energizes the accumulator motor 122, the dispenser brake 110 is once again engaged.

Figures 4A, 4B:
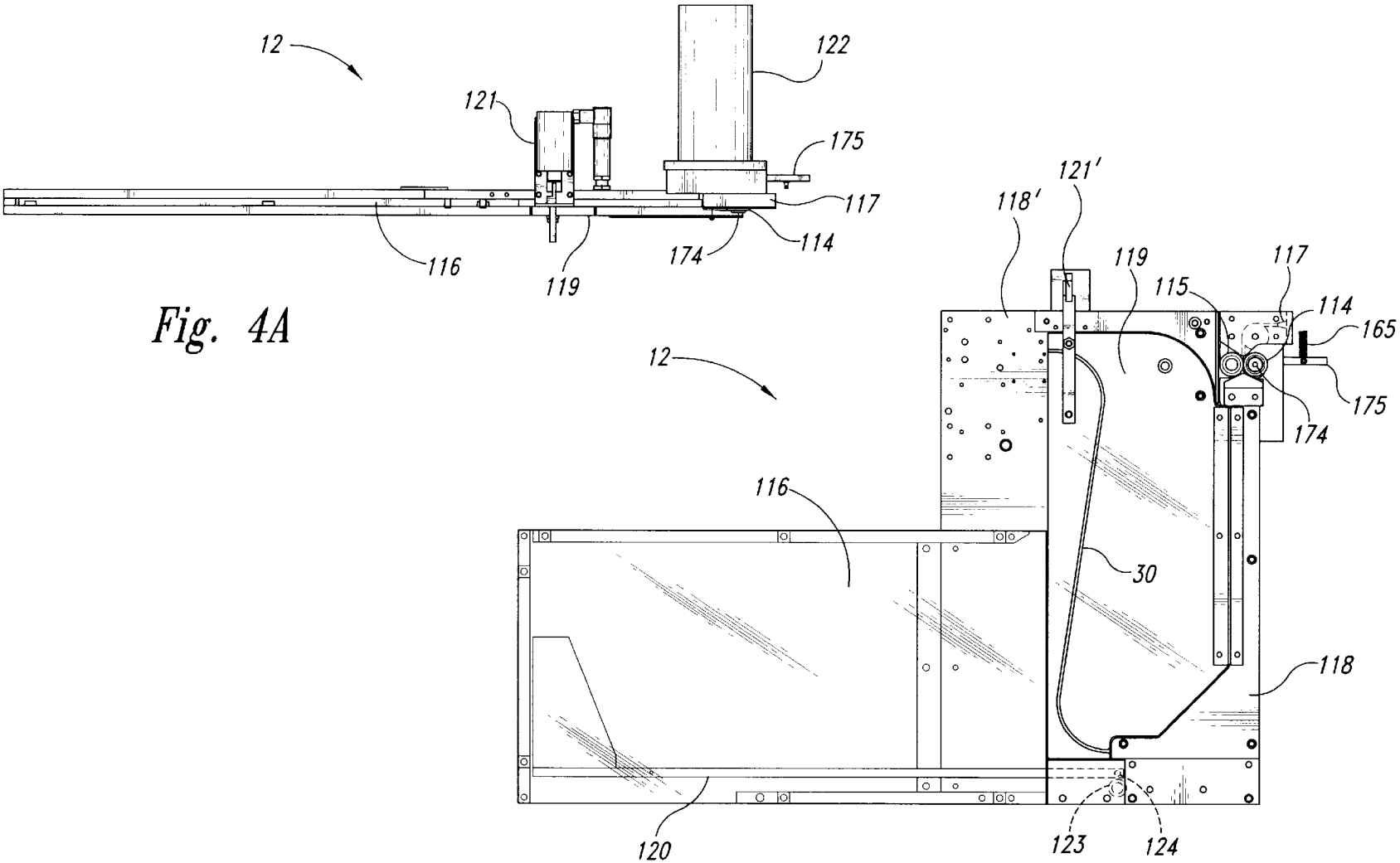
FIG. 4A is a top plan view of a strap accumulator for use by the strapping device of FIG. 1.
FIG. 4B is a front elevational view of the strap accumulator of FIG. 4A.

The strapping material 20 is supplied on a core mounted coil (not shown) that is loaded onto the shaft 17 by removing the outer side plate 18, placing the coil on a dispenser mandrel 24 and replacing the side plate 18. To load the strap 20, the machine 10 must be in a load mode (described below) that allows the accumulator to run and accept the strap. The loose or free end of the strap coil is threaded, by hand, around the guide roller 111, through the strap exhausted switch 112, around the second guide roller 151, and into an accumulator upper guide 117 where it is seized by the rotating accumulator rollers 114 and 115 (FIG. 4B).

The non-contact low strap sensor 113 monitors the coil diameter and provides a control system signal when the coil is nearing depletion. The non-contact low strap sensor employs an optical transducer positioned tangentially along, a path with respect to the dispenser mandrel 24 so as to receive light reflected from the strapping material 20. However, when a sufficient amount of strapping material has left the dispenser 11 so that the reduced diameter of strapping material causes the tangentially mounted optical transducer to fail to reflect off the strap coil diameter, the low strap sensor 113 providing a low strap signal to the control system 200. When this signal is received, the control system illuminates a low strap light (not shown) alerting the operator of the low strap condition.

The strap exhausted switch 112 provides a depleted signal to the control system 200 indicating which of the two dispensers 11 (upper or lower) is currently in use, and whether or not the strap coil has been depleted. Once the depleted signal is received, the control system 200 provides an audible alarm that alerts the operator and retracts the strap from the accumulator unit 12. Thereafter, the control system 200 causes the machine to enter an automatic loading ready sequence.

Assuming that the lower dispenser 11 has depleted its strap, and after the machine 10 has completed the above strap depleted sequence, the loose end of the strap coil from the upper dispenser is fed by hand through the same path as the lower strap coil, except that the threading of the strap exhausted switch 112 will now be routed below the guide roller 111 indicating the upper coil is the active coil. The two position switch provides a first signal to the control system 200 when an actuating lever of the switch is in a first position, indicating that the lower coil is active, and a second position, pivotally displaced from the first position, indicating that the upper coil is active. By threading the strap through one of the two positions, the strap exhausted switch 112 actuating lever is pivotally positioned in the first or second position, providing an appropriate signal to the control system 200. Such a two coil system allows the operator to replace the depleted lower coil while the machine continues to run.

Strap Accumulator Unit

Figure 4C:
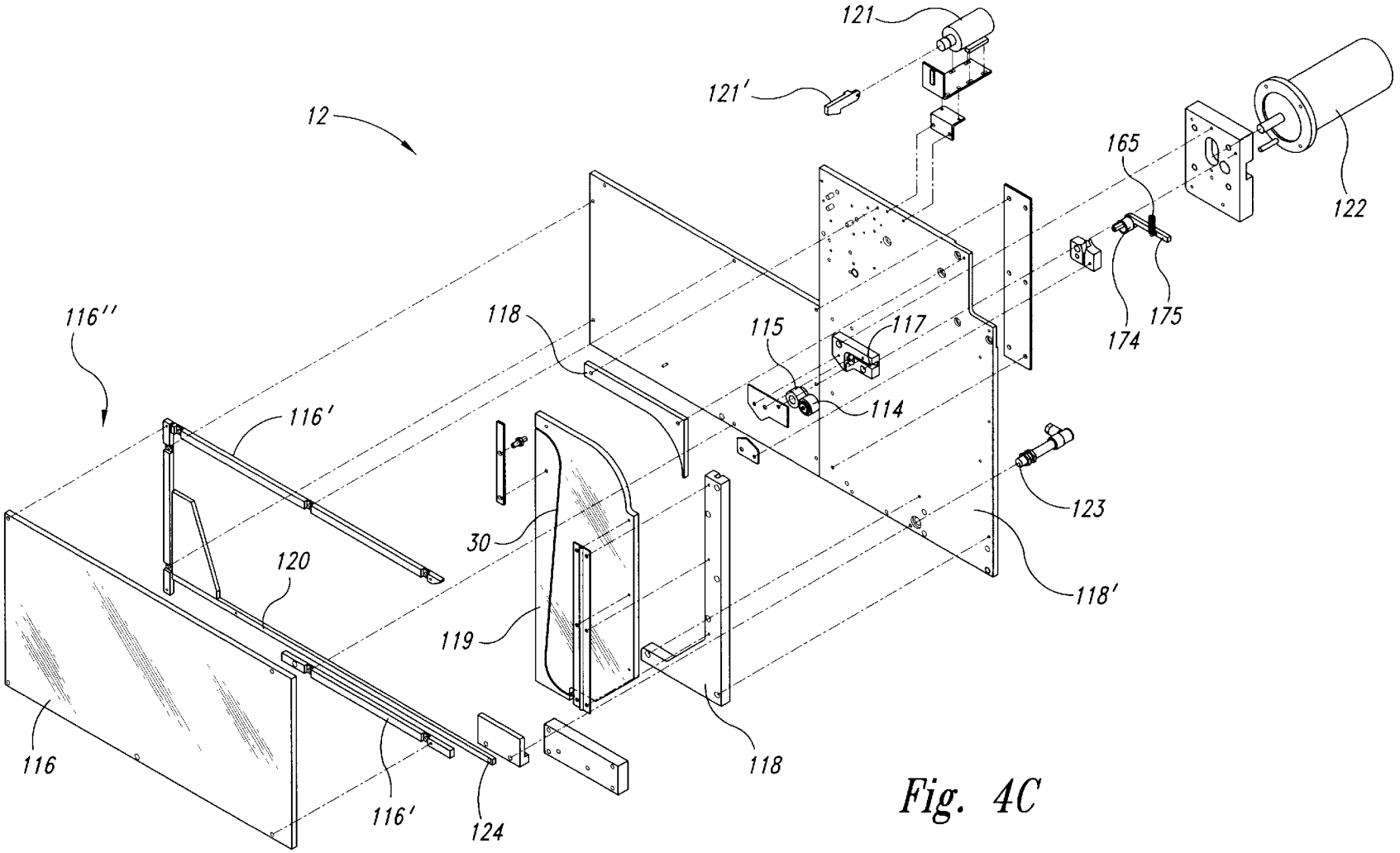
FIG. 4C is an exploded isometric view of the strap accumulator of FIG. 4A.

Referring now to the accumulator 12 shown in FIGS. 4A–4C, the accumulator provides a reservoir of the strap 20 for the strapping operation and the mechanisms necessary for automatic strap loading after the strap has been depleted on one of the two dispensers 11. The accumulator 12 essentially comprises the following elements: a spring 165 that biases a pinch roller 114, a motor driven roller 115, an accumulating chamber window 116, strap guides 117 and 118, an accumulator door 119 with an integral strap guide slot 30, a strap sensor lever 120 and a rear mounting plate 118' to which the elements are secured. The accumulator 12 has three general modes of operation: (1) a load mode, (2) a strapping mode, and (3) a retract mode.

In the load mode, strap is hand fed into the accumulator pinch and drive rollers 114 and 115 respectively from the dispenser 11. The pinch roller 114 is rotatably mounted to an eccentric shaft 174, where the eccentric shaft is mounted at one end of a pinch roller lever 175. The pinch roller 114 is loaded into or biased against the drive roller 115 by a spring 165, which is fixed at the free end of the pinch roller lever. To start the load sequence, the operator presses a load pushbutton (not shown) located in the dispenser area. Once the control system 200, in response thereto, starts the load sequence, the control system energizes an accumulator motor 122 that rotates the motor driven roller 115 to cause the strap 20 to be drawn into the accumulator 12 by the rotating pinch and drive rollers 114 and 115. The strap is guided by the upper and lower strap guides 117 and 118 respectively into a lower section of the accumulator 12 and then guided by a guide 30 in the accumulator door 119 into the feed/tension roller 13 section.

During the loading sequence the control system 200 provides a door closure signal to an accumulator door solenoid 121 to retract a hook-ended lever 119' that holds the accumulator door 119 closed. By holding the accumulator door 119 closed, the strap 20 is confined to the guide slot 30 in the accumulator door 119 and is guided into feed/tension rollers 127 and 129 (FIG. 5B). After the strap has fed through the feed/tension rollers 127 and 129 and into a feed tube 169 (FIG. 5A), a strap sensor 166 (FIG. 5B), coupled to the control system 200 and a strap sensor lever 168, detects the movement of the strap sensor lever. The strap sensor lever 168, which is located on the feed tube 169, provides strap detection signals to the control system 200 when the strap has fed past the feed/tension rollers 127 and 129, indicating that the machine can enter the strapping mode. As explained below with respect to FIGS. 5A–5C, the strap sensor lever is preferably pivoted about the strap sensor so that the free end of the lever is pivotally displaced by the strap moving through the feed tube. In response thereto, the strap sensor, preferably an inductive proximity sensor, outputs the strap detection signal to the control system to indicate that the strap has been properly fed through the accumulator 12 and feed/tension unit 13.

In the strapping mode, the control system 200 releases the accumulator door solenoid 121, which allows the spring-loaded accumulator door 119 to retract allowing the strap to move out of the guide slot 30 in the door and into a main accumulator chamber 116" formed by the window 116, a leftward portion of the rear mounting plate 118', and spacers 116' positioned therebetween. The window 116 and door 119 are transparent to allow the operator to view the strap 20 (not shown in FIG. 4C) within the accumulator unit 12. The control system signals the accumulator motor 122 to continue to run and fill the accumulator chamber 116" with strap until there is sufficient strap to provide a downward weighting force that depresses the pivotally mounted strap sensor lever 120 from a rest to a full position. After the strap sensor lever 120 is filly depressed, an accumulator back plate mounted hall effect sensor 123 detects a magnet 124 mounted on a proximate end of the wand 120. The hall effect sensor 123 is coupled to and provides a strap full signal to the control system 200 indicating that the accumulator chamber 116" is full. After the accumulator chamber 116" has filled, the control system 200 provides a de-energizing signal to the accumulator motor 122 and the machine 10 is then ready for the automatic feed sequence described below with respect to the feed/tension unit.

The retract mode is controlled automatically and is used to clear the machine 10 of a piece of previously depleted strap 20, thereby enabling the machine to be easily loaded. After the strap exhausted switch 112 on the dispenser 11 (FIG. 2) detects a depleted coil and sends an appropriate strap exhausted signal to the control system 200, the control system causes the accumulator motor 122 to stop. Strap is then supplied from the accumulator chamber 116" until the hall effect sensor 123 fails to detect the magnet 124, indicating that the accumulator chamber 116" is not full. In response to the not full signal from the hall effect sensor 123, concurrently with the strap exhausted signal from the strap exhausted switch 112, the control system 200 provides a reverse signal to the accumulator motor 122 and a feed and tension unit motor 126 (discussed below)., which ejects the remaining strap in the accumulator 12 from the machine. At this time, the control system 200 returns the machine 10 to the load mode and the strap, from the previously loaded coil, can be threaded through the strap exhausted switch 112 into the accumulator rollers 114 and 115, thus beginning another load sequence.

Feed and Tension Unit

Figure 5A:
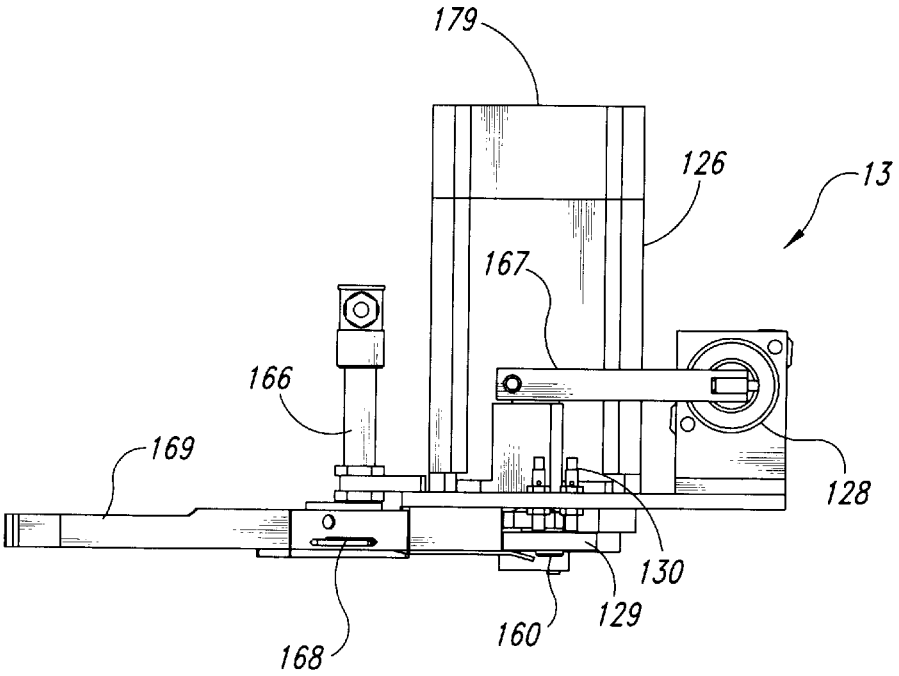
FIG. 5A is a top plan view of a strap feed/tension unit for use by the strapping device of FIG. 1.
Figure 5B:
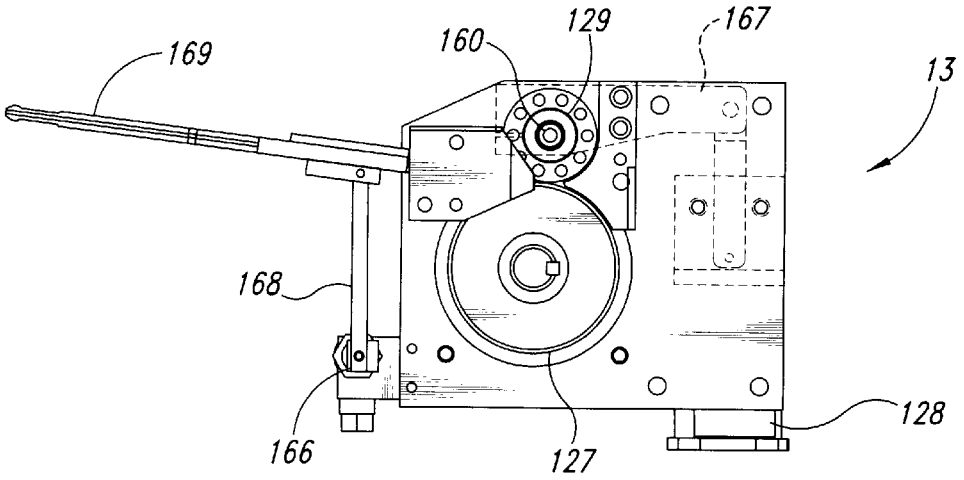
FIG. 5B is a front elevational view of the feed/tension unit of FIG. 5A.
Figure 5C:
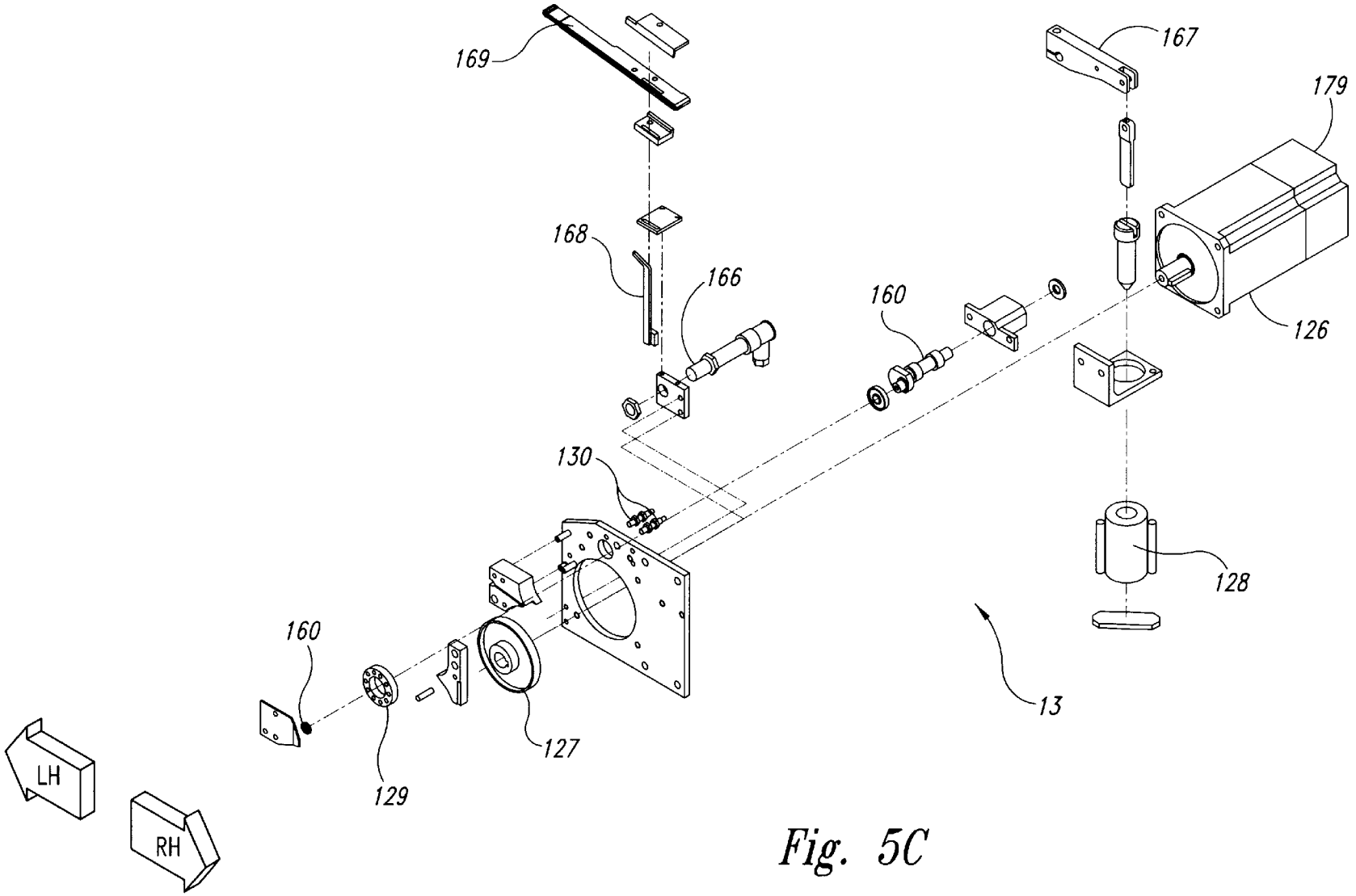
FIG. 5C is an exploded isometric view of the feed/tension unit of FIG. 5A.

Referring now to FIGS. 5A–5C, the feed and tension unit 13 provides a means for feeding the strap around the track 14 and provides primary tension during the tensioning sequence. The feed and tension unit 13 comprises a brushless DC servo motor 126 that drives a driven roller 127 against a solenoid loaded pinch roller 129, which is equipped with inductive proximity sensors 130. A feed tube 169 that receives the strap 20 is equipped with the strap sensor 166, as noted above. The servo motor 126 is equipped with a digital encoder 179 that provides closed loop control signals to the control system 200 to monitor position, speed and acceleration of the drive roller 127.

The pinch roller 129 is selectively loaded by the solenoid 128 using a pinch lever 167 coupled to the solenoid at a first end and at a free end to an eccentric shaft 160. The pinch roller is rotatably mounted to a free end of the eccentric shaft so that when the control system 200 provides energizing signals to the solenoid 128, the solenoid pivots the pinch lever 167 to cause the pinch roller 129 to be biased against the drive roller. As shown in FIG. 3, the solenoid is controlled by a pulse width modulation (PWM) circuit providing a variable force to the pinch roller 129, and thus a variable pinch force on the strap 20 for the various modes of operation discussed herein.

Inductive proximity sensors 130 are used to provide quadrature tracking signals to the control system 200, which monitors strap position and response with respect to the drive roller rotation. The tracking signals provide closed loop tension control by allowing the control system to compare the signals from the feed/tension encoder 179 to the proximity sensors 130 information, as described below. The proximity sensors 130 and digital encoder 179 preferably employ conventional quadrature encoding, each using pairs of sensors, so that both magnitude and direction of rotation of the drive and pinch rollers can be detected by the control system 200. While the proximity sensors 130 are inductive encoders that detect the varying magnetic flux caused by the rotation of a plurality of radially positioned holes placed around the edge of the pinch roller 129, other encoding methods can be employed, as are known by those skilled in the art, such as optical encoding, brushed or brushless electrical encoding, etc.

The feed and tension unit 13 has three modes of operation: (1) load mode, (2) primary tension mode, and (3) feed mode. During the load mode, the strap 20 is fed by the accumulator rollers 114 and 115 into the feed/tension rollers 127 and 129 where the strap is picked up and driven to the strap sensor lever 168 located in the feed tube 169. After the strap has reached the strap sensor lever 168, the sensor lever is pivotally displaced by the strap to cause the strap sensor 166 to provide the strap detect signal to the control system 200. In response thereto, the control system 200 pauses the feed sequence and de-energizes the accumulator solenoid 121 which releases the accumulator door 119, allowing the accumulator chamber 116" to fill with strap (FIG. 4B). During the filling sequence, the control system 200 establishes a zero point for the feed/tension motor 126 by advancing the strap slowly to the lever 168 and stopping when the sensor 166 initially activates to send the strap detect signal to the control unit 200. When the lever 168 is first displaced and the strap detect sensor 166 first provides a strap detect signal to the control system, the control system establishes a zero point that is used to accurately determine the position of the strap despite future slippage between the drive and pinch rollers. Detecting initial actuation of the sensor 166 occurs only during each retry or during the loading sequence.

After the strap 20 has filled the accumulator chamber 116", and the hall effect sensor 123 provides a strap full signal to the control system 200, the control system provides a fast forward signal to the feed/tension motor 126 that rapidly advances the strap through the feed tube 169 and sealing head 16 (FIG. 9C), around the track 14 (FIG. 5B) and finally back into the sealing head. During this time, the control system 200 provides a light force to the pinch roller solenoid 128 to maintain a light force between the feed/tension rollers 127 and 129 while the control system monitors the rollers to ensure both rollers are rotating at the same surface speed. This ensures that, if the strap 20 does not complete the feed, the strap will not be damaged by the feed/tension rollers 127 and 129 before the feeding sequence can be terminated. If the control system 200 senses a speed differential between the digital encoder 179 and inductive proximity sensors 130, the feeding sequence is immediately terminated and the control system initiates another homing sequence and establishes another zero point. After the homing sequence has been completed, another feed sequence is attempted. This homing and feed sequence can be repeated several times as determined by the control system. If the control system has repeated the homing and feed sequences a predetermined number of times without success, then the control system provides an error signal to the operator, who must manually feed the strap or determine and correct a problem in the machine. When the control system 200 successfully completes a feed sequence, the machine is ready for the normal strapping operation.

In the primary tension mode of normal strapping operation, straps can be applied to packages either in the manual or automatic mode described above. Two tensioning sequences are available in the primary tension mode: (1) loop size control mode, and (2) tension mode. These modes can be automatically selected by package height sensors (not shown) that are upstream side of the machine, and which provide height signals to the control system 200. Alternatively, these modes are selected from the machine's touch screen control panel (not shown) by the operator. The machine 10 can also employ a combination of the two modes. The control system 200 begins the primary tension mode by rotating the sealing head 16 (FIG. 9C) to engage a right hand gripper 148 which grasps the loose end of the strap. As the sealing head 16 continues to rotate, the track guide 132 (FIG. 8C) is opened, the strap is released from a track guide, and the tensioning sequence begins. During the tensioning sequence, the strap is drawn down rapidly around the package as explained below.

In the loop size control mode, the control system 200 draws the strap 20 down to a predetermined loop size by monitoring the pulse signals from the feed/tension encoder 179 and/or proximity sensors 130. When the control system has received a predetermined number of pulses from the proximity sensors 130, the control system decelerates the feed/tension motor 126 to a controlled stop. The control system 200, however, causes the sealing head 16 to continue to rotate and the feed/tension motor 126 to continue to hold its position until a left hand gripper 149, in the sealing head 16, secures the strap end being tensioned based on the position of a left hand gripper cam and follower (discussed below).

In the tension mode, the strap 20 is drawn tight around the bundle or package until the motor driven roller 127 begins to slip on the surface of the strap. The pinch roller 129, conversely, maintains contact with the strap and is an indicator of strap position and velocity. The control system 200 detects this slippage from the differential in signals between the feed/tension encoder signals and the pinch roller proximity sensors signals. After the control system detects a predetermined differential set point between the signals, the control system decelerates the feed/tension motor 126 and increases the pinch solenoid 128 force through the PWM circuit. In response thereto, the feed/tension motor 126 continues to tension the strap, at a slower speed, to a predetermined force where the feed/tension motor 126 maintains tension on the strap. If the high tension mode has been selected, the high or secondary tension unit 15 will apply final tension to the strap, as described below, before the sealing operation takes place. After the left hand strap end has been secured, strap tension is released before the cutting/sealing operation to prevent strap splitting during the cutting operation. The sealing head 16 continues to rotate through the tensioning sequence and into the cutting/sealing sequence as described below.

During the feed mode, which occurs after the strap cutting/sealing sequence begins, the feed/tension motor 126 begins the feeding sequence which continues throughout the sealing operation. At the end of the sealing head rotation, the sealing head cover slide 153 retracts, releases the strap onto the package and returns to its original closed position.

During the sealing cycle, the control system 200 continues to feed the strap around the track 14 until it enters the sealing head 16 on the second pass, coming to rest just past the sealing press platen 152 (FIG. 9C). The control system 200 monitors the length of strap dispensed in the feed mode by monitoring signals from the encoder 179. After a predetermined number of encoder pulses have been received by the control system, the feed/tension motor 126 is decelerated and stopped at the appropriate location. The termination of the feed sequence completes the strap application cycle and the machine is now ready to apply another strap.

Figure 9B:
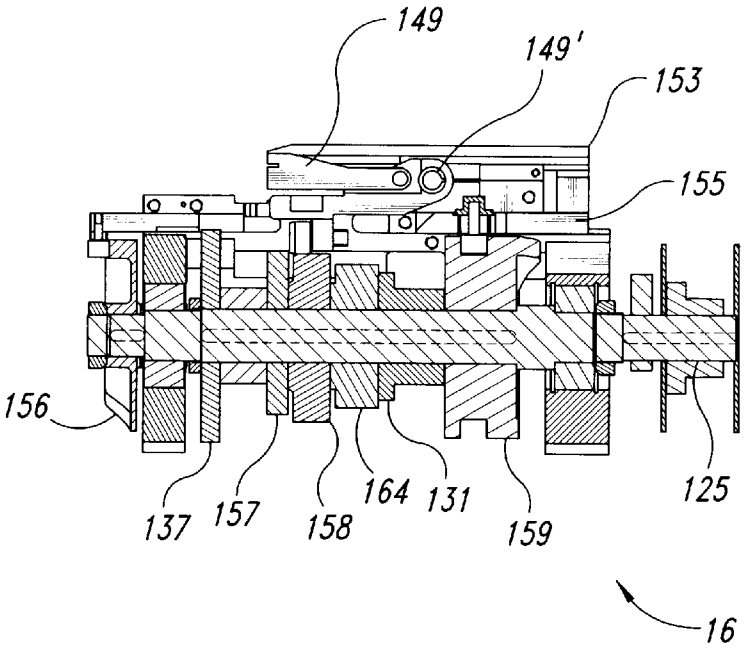
FIG. 9B is a cross sectional view of the sealing head of FIG. 9A taken along the line 9B—9B.
Figure 9A:
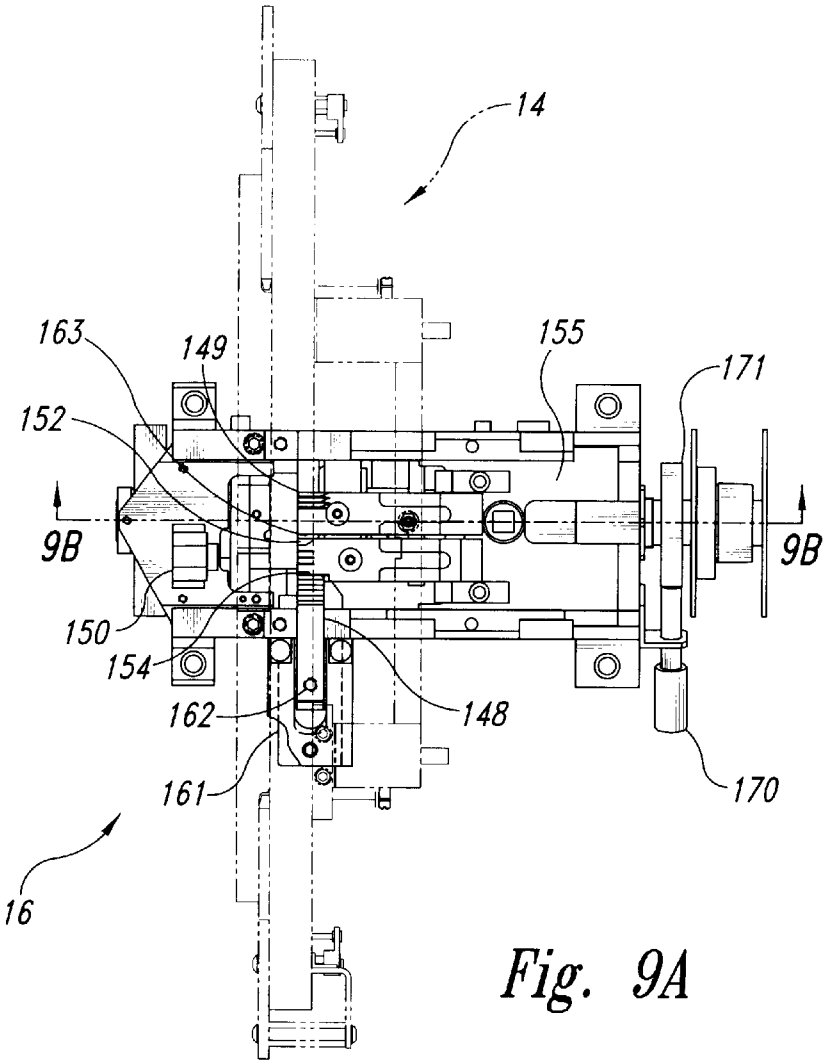
FIG. 9A is a top plan view of a sealing head for use by the strapping device of FIG. 1.
Figure 13:
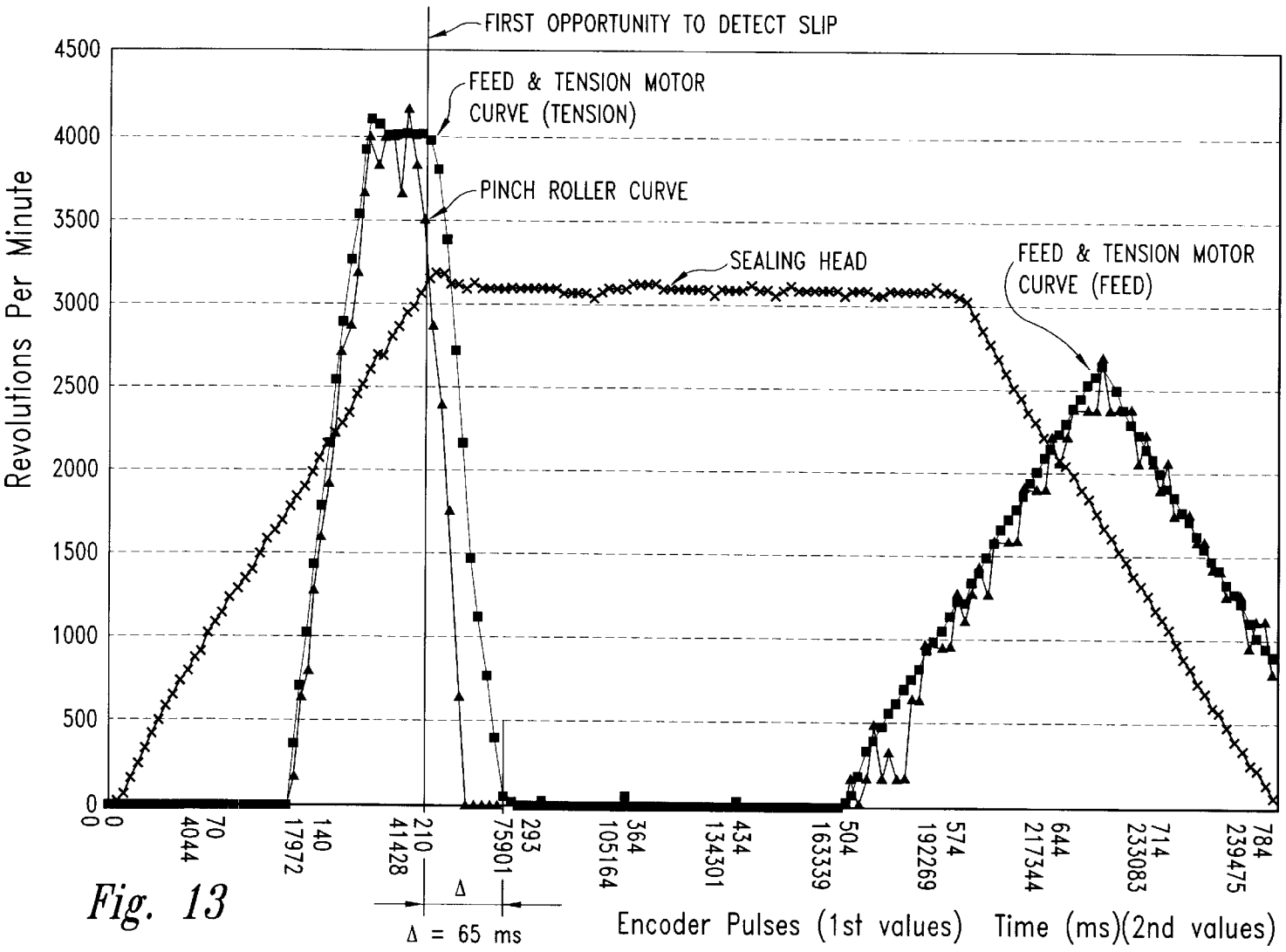
FIG. 13 is a plot of time and encoder pulses versus revolutions per minute of a feed and tension motor and pinch roller of the feed/tension unit of FIG. 5A and the sealing head of FIG. 9A.

FIG. 13 shows an exemplary plot of time and encoder pulses versus revolutions per minute of a feed and tension motor and pinch roller of the feed/tension unit of FIG. 5A and the sealing head of FIG. 9A. The sealing head curve begins rotation and accelerates as its revolutions per minute versus time increases, until the sealing head plateaus at a constant velocity, and thereafter decelerates. During the initial acceleration of the sealing head, the feed/tension motor 126 and pinch roller 129 rapidly accelerate to a peak velocity of about 4,000 revolutions per minute. At about 210 milliseconds (about 48,000 encoder pulses) the feed/tension motor 126 experiences slippage with respect to the strap. Under the exemplary curves of FIG. 13, a small diameter track unit 14 is employed to provide straps around small bundles. As a result, the machine 10 is operated primarily in the loop size control mode. Therefore, the feed/tension motor 126 is, at this time, decelerated. Approximately 65 milliseconds later, the feed/tension motor 126 stops. Alternatively, if the machine 10 were operated at a slower strapping rate, with a larger track diameter sizes, with larger bundles, etc., the control system 200 can initiate deceleration of the feed/tension motor 126 at the initial detection of slippage in the strap (about 210 milliseconds). At approximately 504 milliseconds, the control system 200 reenergizes the feed/tension motor 126 and pinch roller 129 to begin feeding strap through the track unit 14 for the next strapping operation, while the sealing head completes the current strapping operation and is decelerating.

Track Unit

Figure 8A:
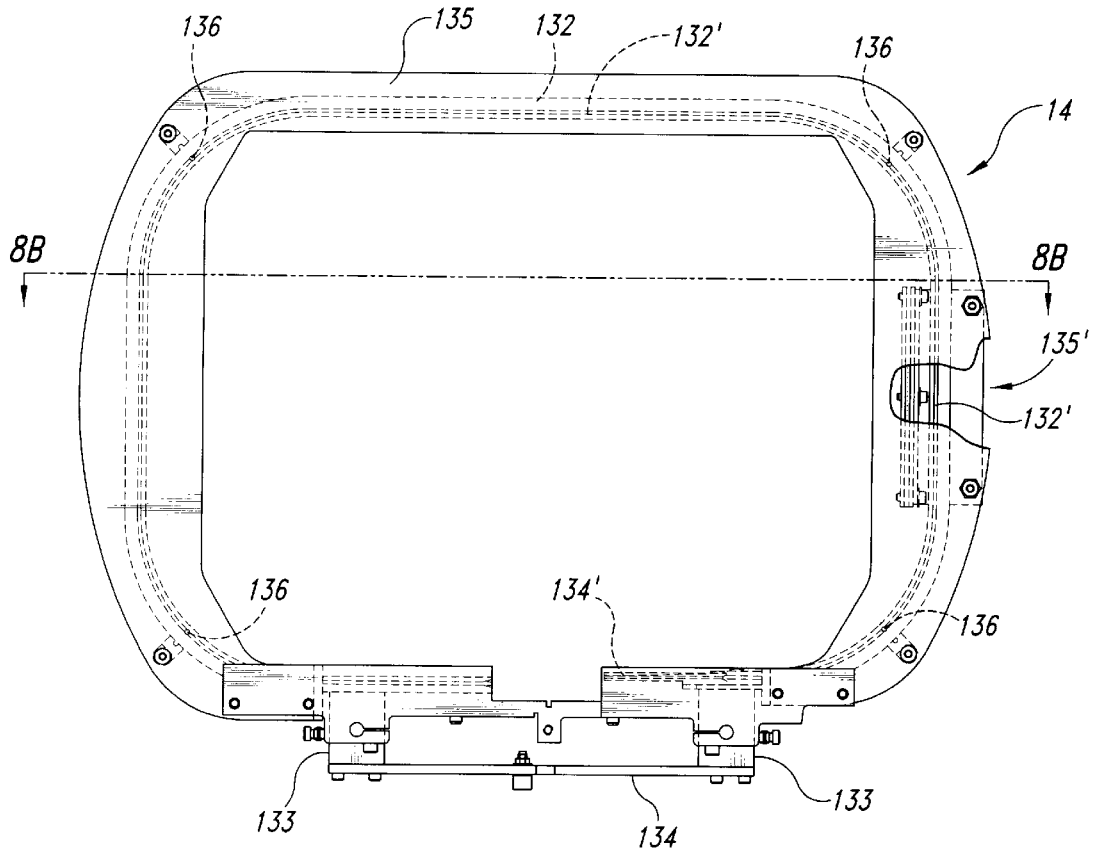
FIG. 8A is a front elevational, and partial fragmentary, view of a track for use by the strapping device of FIG. 1.
Figure 8B:
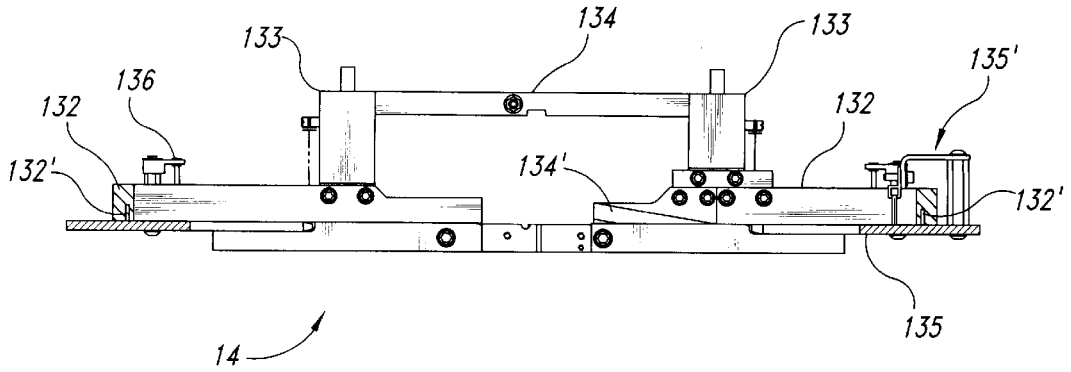
FIG. 8B is a cross-sectional view of the track of FIG. 8A, taken along the line 8B—8B.
Figure 8C:
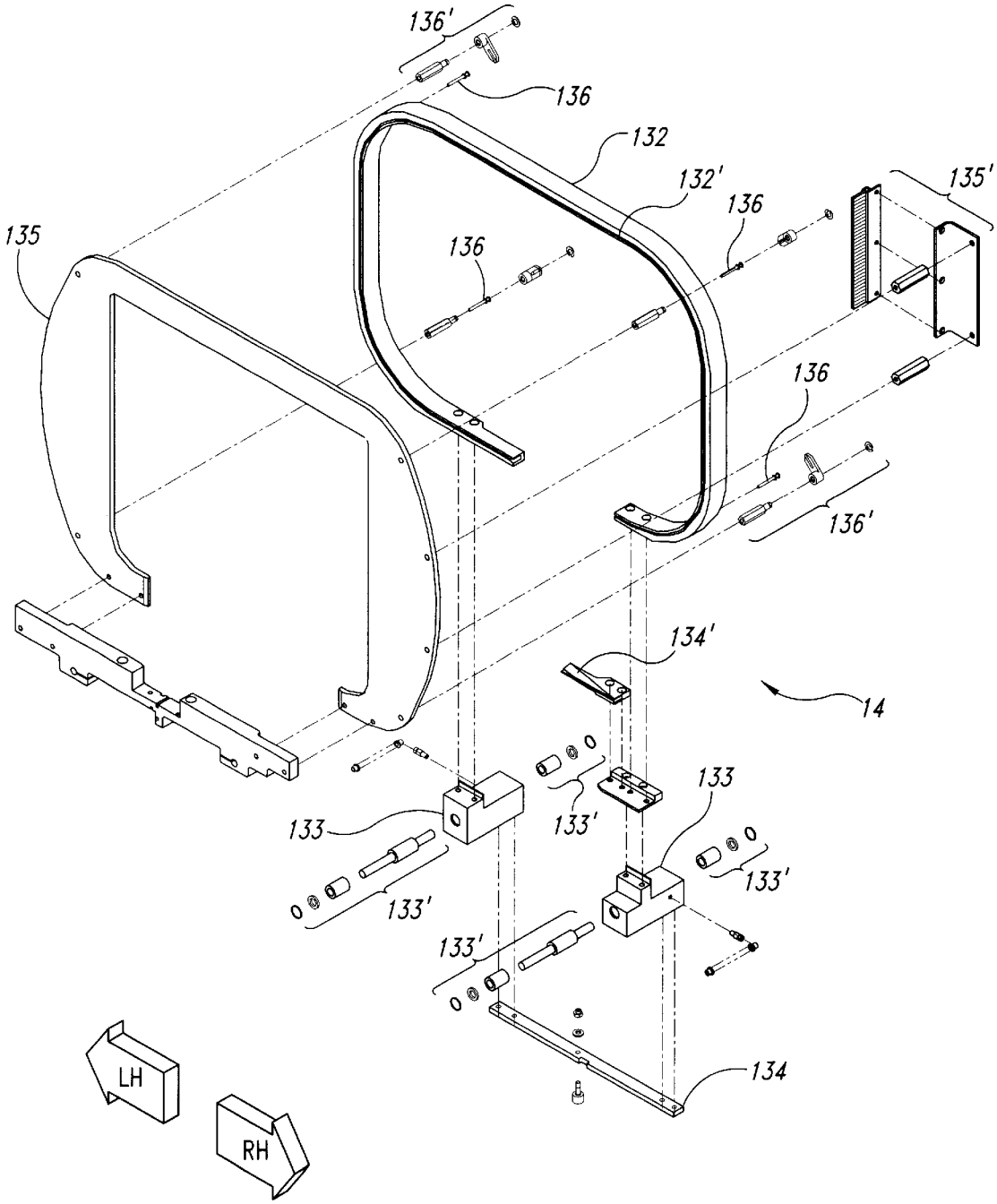
FIG. 8C is an exploded isometric view of the track of FIG. 8A.
Figure 9C:
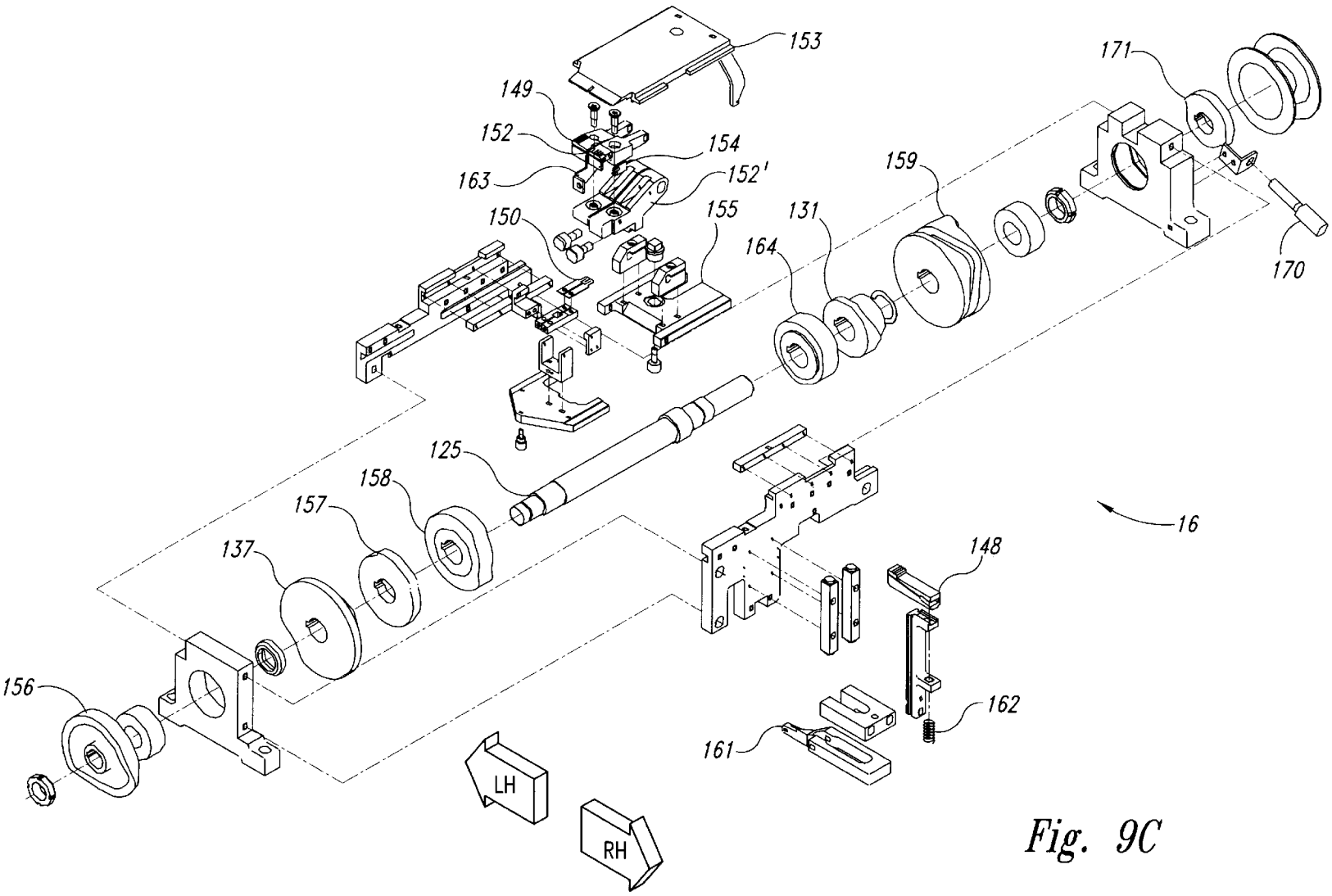
FIG. 9C is an exploded isometric view of the sealing head of FIG. 9A.

Referring to FIGS. 8A–8C, the track 14 includes a track guide 132, which has a slot 132' that guides the strap 20 to form a large loop, starting with the first pass through the sealing head 16 and ending again in the sealing head 16 on the second pass. The track guide 132 retains the strap until the next strapping cycle is initiated. The track essentially comprises. (1) the strap guide 132 whose slot 132' is preferably made of a low friction material, (2) track support blocks 133 with integral linear bearing assemblies 133', (3) a track opening linkage 134, (4) a track cover 135, and (5) four cover mounted strap stripper pins 136.

The track guide 132 is secured at a lower end to the track support blocks 133, which are slideably moveable with respect to the cover 135, by means of the bearing assemblies 133'. The track opening linkage 134 is secured to an underside of the track support blocks 133, and is operably coupled to a track cam 131 (FIG. 9C), so that as the track cam moves, the linkage, track support blocks, and track guide are laterally displaced with respect to the cover 135.

The four stripper pins 136 are fixed to the track cover 135 at a periphery of four opposite points from the track guide 132, by means of track pin support assemblies 136'. The track pin support assemblies 136' retain the track pins 136 within holes in the track guide, whereby in a first position when the track guide rests against the track cover, the pins extend only partially within the track guide (as shown in FIG. 8A). However, in a second position, when the track guide is laterally displaced from the track cover, the pins extend within and through the holes, into the slot 132' to push the strap 20 from the slot.

During the strapping cycle, a track cam 131 in the sealing head 16 (FIG. 9C) actuates the track opening linkage 134 to laterally displace the track guide 132 with respect to the track cover 135, while simultaneously stripping the strap from the track guide 132 by the stripper pins 136 mounted to the track cover. The track guide 132 remains laterally displaced from the track cover or "open" until the sealing cycle begins when it closes again for another strap feed sequence. The track guide 132 remains closed throughout the rest of the cycle until another strapping cycle begins.

A guide track 134' affixed to a top of one of the track blocks 133, provides a tapering slot from the feed/tension unit 13 to an entry point of the track guide 132 to facilitate entry of the free end of the strap 20 during each feed sequence. A brush unit 135' is mounted to the track cover 135 and includes an elongated brush, consisting of a plurality of bristles extending parallel to one of the two vertical sides of the track guide 132, adjacent to and within the interior of the track guide. When the track guide 132 opens, the strap rests against an exterior edge of the brush momentarily before being drawn down and about the object. As a result, the brush and the brush unit 135' ensures that the strap does not twist as it is initially drawn about the object.

Secondary (High) Tension Unit

Figure 6B:
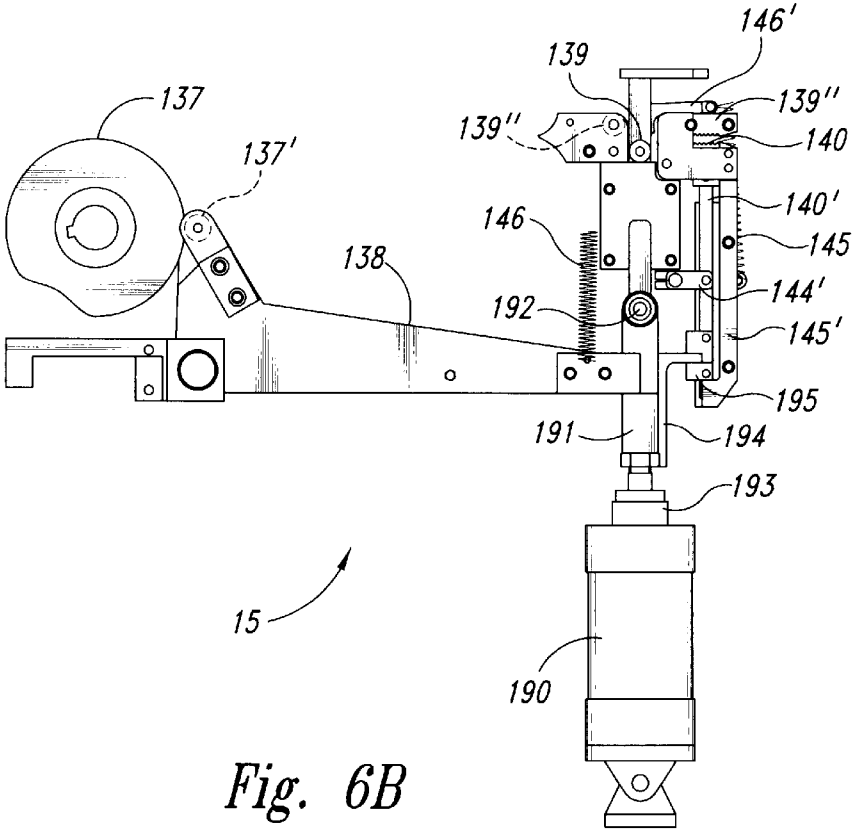
FIG. 6B is a front elevational view of the secondary tension unit of FIG. 6A.
Figure 6A:
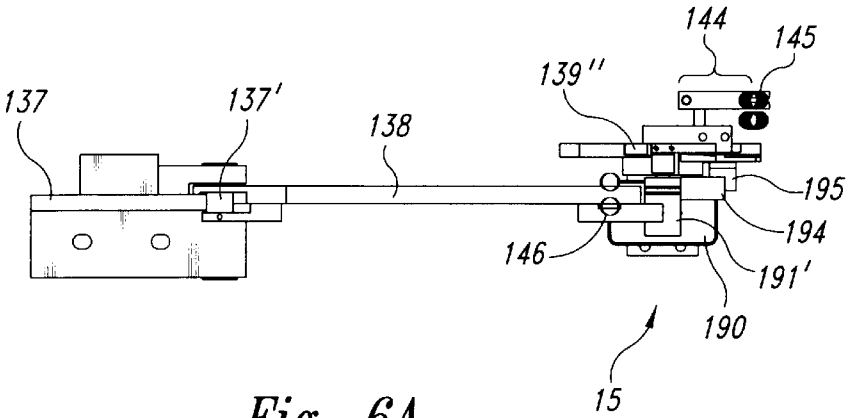
FIG. 6A is a top plan view of a secondary tension unit for use by the strapping device of FIG. 1.
Figure 6C:
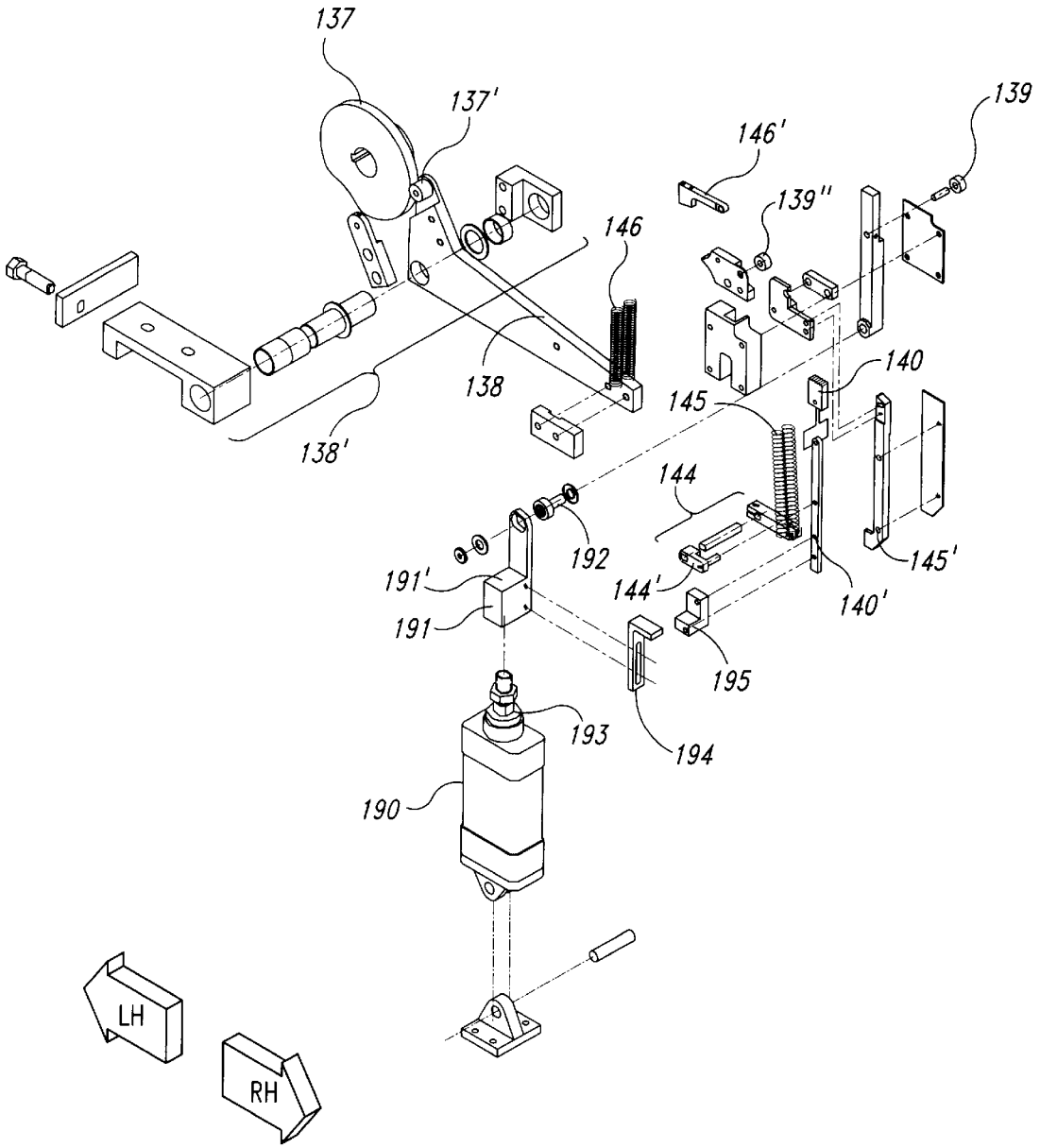
FIG. 6C is an exploded isometric view of the secondary tension unit of FIG. 6A.
Figures 6D, 6E:
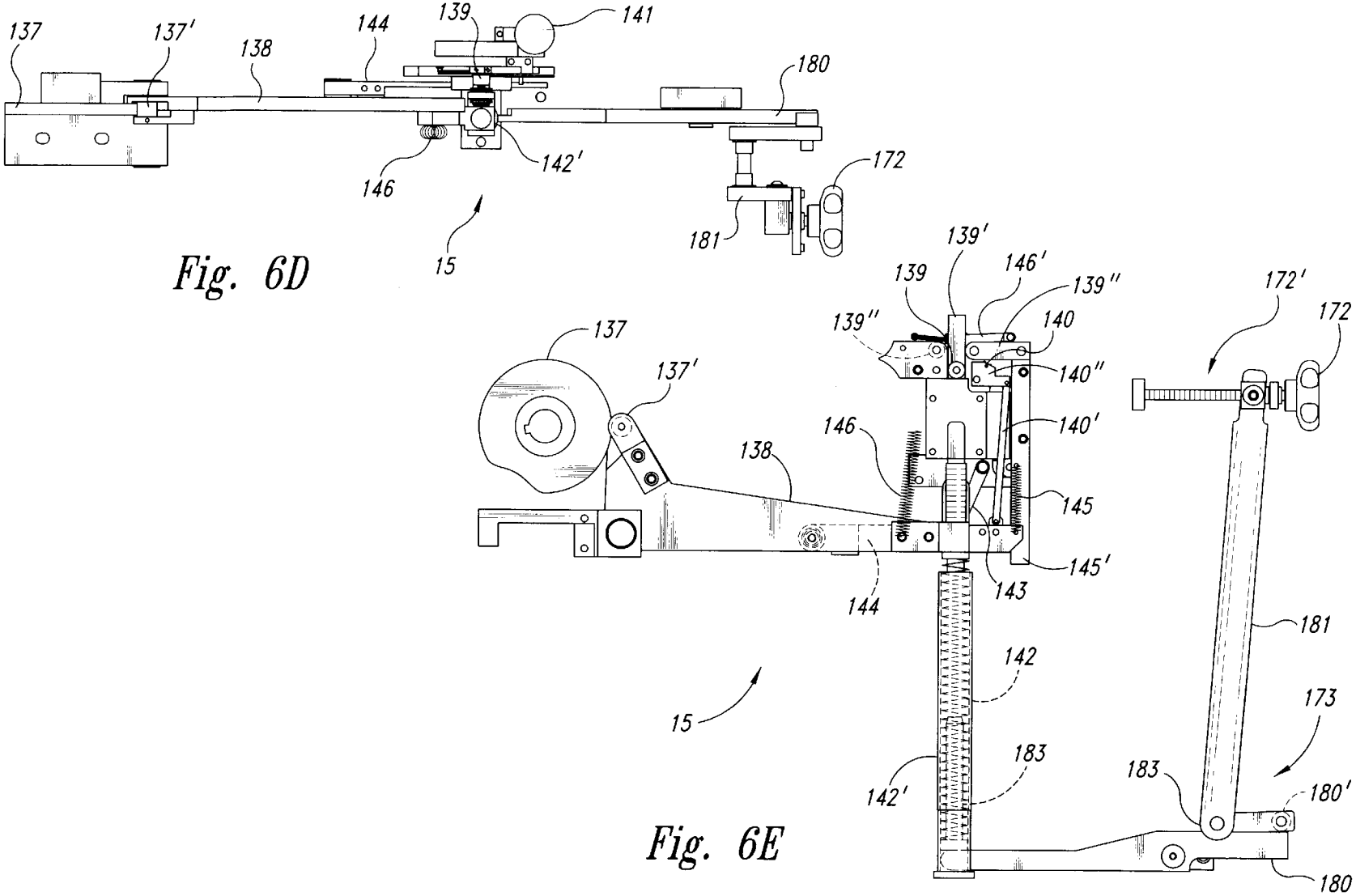
FIG. 6D is a top plan view of an alternative embodiment of the secondary tension unit of FIG. 6A.
FIG. 6E is a front elevational view of the alternative embodiment of the secondary tension unit of FIG. 6D.
Figure 6F:
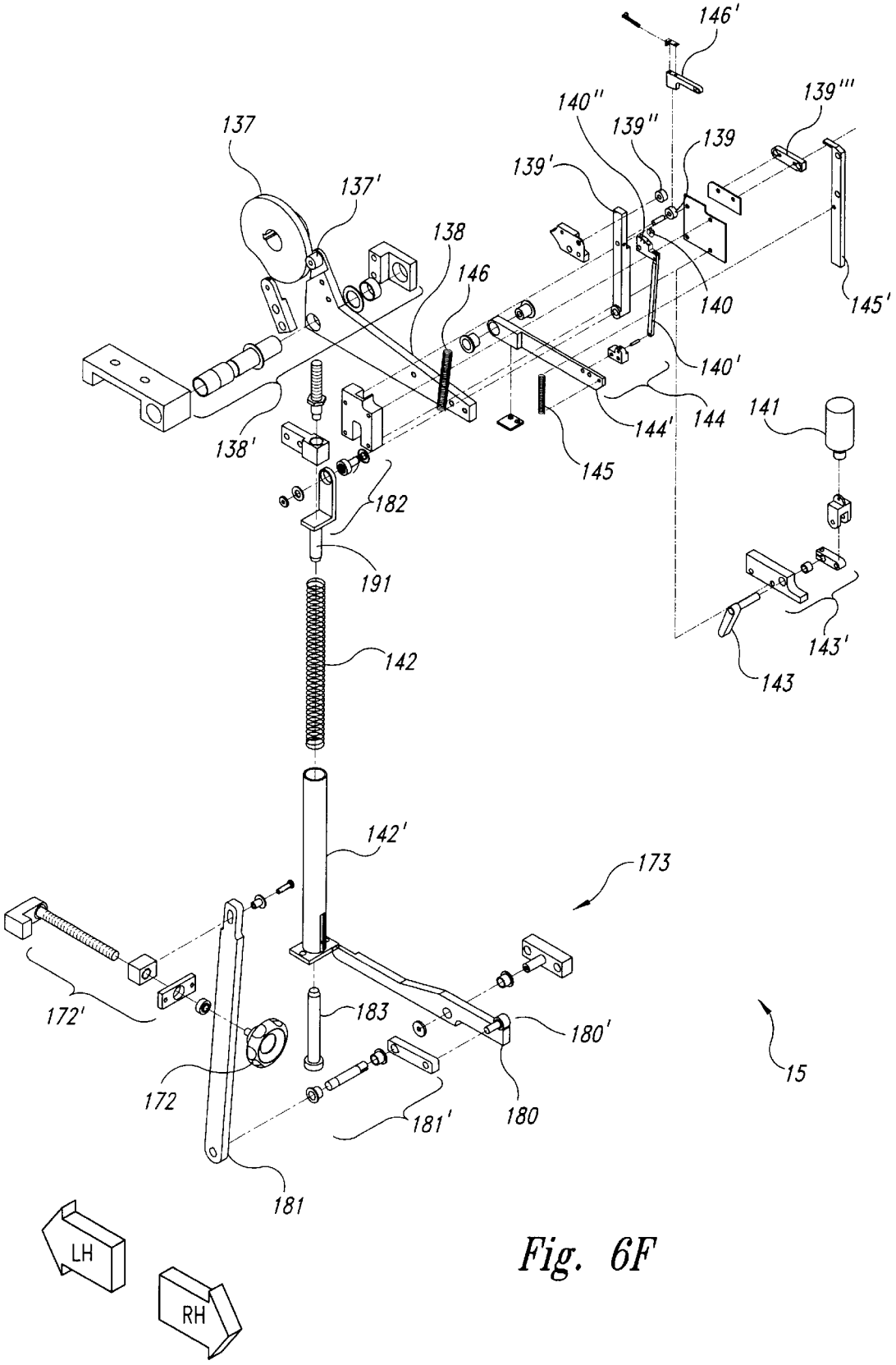
FIG. 6F is an exploded isometric view of the alternative embodiment of the secondary tension unit of FIG. 6D.

Referring to FIGS. 6A–6C, the secondary tension unit 15 provides final strap tension after the primary tension sequence has been completed. Secondary tension is not required on all packages and the secondary tension unit 15 is provided with a means for the control system 200 to disable it. The secondary tension unit 15 essentially comprises: (1) a sealing head main shaft mounted tension cam 137, (2) a cam driven tension arm 138, (3) a spring actuated tension roller 139, (4) a strap gripper 140, and (5) a pressure regulated pneumatic cylinder 190 that provides adjustable strap tension. As explained below, the tension cam 137 is mounted to the main shaft of the sealing head (FIG. 9C), and controls the pivotal movement of the tension arm 138 by means of a cam follower roller 137' mounted on the tension arm. A pivot assembly 138, secured to the housing frame of the machine 10, pivotally retains the tension arm 138.

The tension roller 139 is rotatably received by an upwardly extending roller slide 139', which has a free end coupled to a free end of the tension arm 138. A non-laterally moveable roller 139", rotatably mounted to a series of plates, receives the strap 20 thereunder, where the strap then loops over the roller 139 before passing underneath a rounded guide block 139"'. A hammer-shaped lever 146' is pivotally attached at a first end. The free or "head" end of the lever 146' is spring biased downward to rest against an upper surface of the tension roller 139 to help guide a free end of the strap 20 through the secondary tension unit 15 during initial loading of the strap. During strapping operations, the lever 146' rests against an upper surface of the strap and biases a loop of the strap downwardly within the secondary tension unit 15, to restrict movement of the strap vertically. A gripper linkage 140' pivotally receives the strap gripper 140 at one end, whereby the gripper linkage 140' is pivotally coupled at its free end to an L-shaped block 195. A gripper actuator linkage 144 includes an actuating arm 144' that is pivotally coupled at a first end to a frame of the machine 10 or a stable portion of the accumulator unit 12. A free end of the actuating arm 144' is coupled to the gripper linkage 140' and provides an upward actuator force on the gripper linkage, as described below.

Figure 7A:
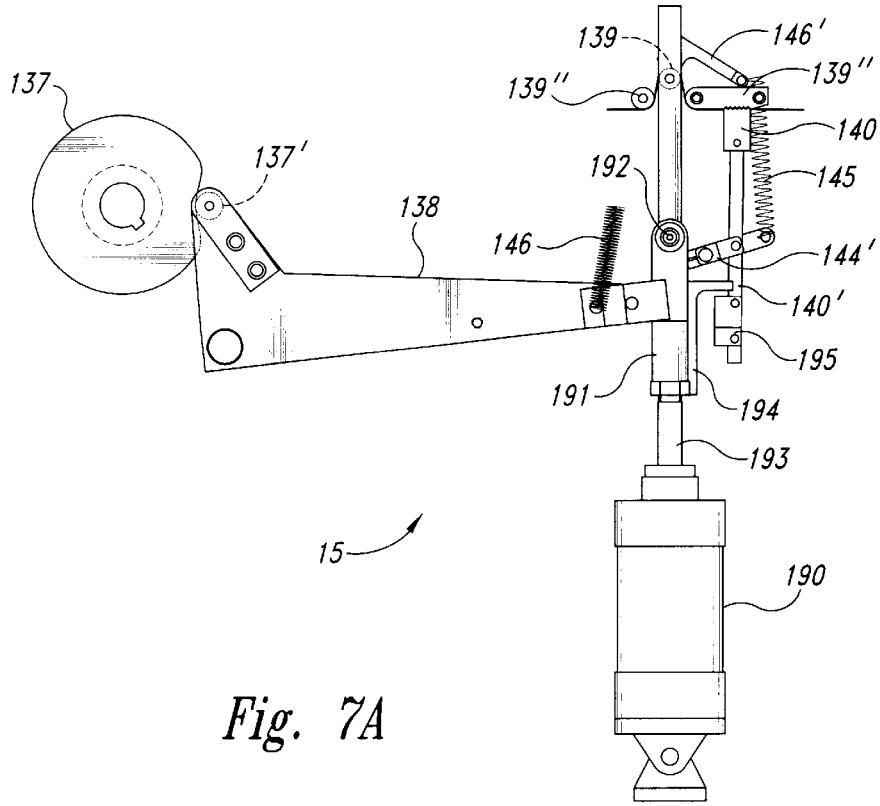
FIG. 7A is a front elevational view of a portion of the secondary tension unit of FIG. 6A showing a high tension position.

In the home position of the tension arm 138 (FIG. 7C), the tension arm 138 is downwardly displaced, which downwardly displaces a hammer-shaped cylinder eye 191 that is coupled to a cylinder rod 193 of the pneumatic cylinder 190. A lower surface of tension arm 139 rests against an upper surface 191' of the cylinder eye 191. An L-shaped bracket 194 is adjustably coupled to a side of the cylinder eye 191, and a free end of the L-shaped bracket hooks over and rests upon an upper surface of the L-shaped block 195. As a result, when the tension arm downwardly displaces the cylinder eye 191, the L-shaped block 195, the gripper linkage 140' and the gripper 140 are similarly downwardly displaced. In the high tension position, however (FIG. 7A), a spring 146 upwardly displaces the tension arm 138 so that it does not rest against the upper surface 191' of the cylinder eye 191. As a result, the gripper linkage 140' and gripper 140 are displaced upwardly, forcing the gripper 140 upwardly against the strap and guide block 139"'. The underside of the guide block 139"' can include teeth or other surface deformations so that the guide block 139"', in addition to the teeth of the strap gripper 140, secure the strap therebetween.

The gripper 140 is pivotally mounted to the gripper linkage 140' allowing the gripper teeth to remain parallel and mesh with the teeth on the undersurface of guide block 139"', thereby ensuring a proper gripping action. One or more gripper springs 145 coupled between the gripper actuator linkage 144, and a stationary portion of the machine 10, provide an upward spring force to the actuating arm 144' and gripper linkage 140', whereby the spring force controls the amount of force supplied by the strap gripper. As a result, the strap is positively locked between the guide block 139" and strap gripper 140 prior to high tensioning.

In operation, after the primary tension sequence has been completed, the sealing head 16 continues to rotate as the tension cam 137 actuates the tension arm 138. With secondary tension enabled, the strap gripper 140 anchors the strap 20 against the underside of the guide block 139''', during the tension arm 138 movement, to prevent any lengths of strap from being drawn from the accumulator 12. As the tension arm 138 moves through its travel from its home position (FIG. 7C) to the high tension position (FIG. 7A), the pneumatic cylinder 190 is released to provide an upward force, allowing the roller 139 to tension the strap to the force capability of the pneumatic cylinder. The control system 200 can control an amount of force supplied by the pneumatic cylinder 190. The pneumatic cylinder 190 provides a higher force capability and a constant force, as opposed to an alternative embodiment, described below, which employs a spring.

The pneumatic cylinder 190 includes an electrically operable control valve that is electrically coupled to the control system 200. The valve preferably is a two-position valve whereby a first signal from the control system 200 (such as a power-up or energizing signal) causes a cylinder rod 193 to extend outwardly from the pneumatic cylinder. In response to a second (inhibit) signal (such as a power-off or deenergizing signal), the cylinder rod retracts. When the control system 200 supplies the inhibit signal to the pneumatic cylinder 190(. the control valve is actuated and the pneumatic cylinder 190 draws the arm 144 downwardly. The force set point of the pneumatic cylinder 190 can also be adjustable by the operator for the particular product being strapped. An air pressure regulator for controlling the cylinder output force (not shown), is provided in the machine 10, where the regulator is manually adjustable to provide variable secondary strap tension. Alternatively, the regulator is electrically coupled to, and controlled by, the control system 200 so that the control system adjusts the tension force. Overall, the pneumatic cylinder 190 acts as a constant force spring during each strapping cycle. The pneumatic cylinder is clevis mounted to the base frame of the machine 10 and pivotally mounted to the roller slide 139' via the eye of the cylinder eye 191, and spherical bearing 192 secured thereto, which together is mounted as a unit to the cylinder rod 193.

Since the tension arm 138 is cam 137 actuated, the arm 138 travels fill stroke each cycle. As with other cam actuated members in the machine 10, the tension arm does not snap back under any uncontrolled spring action. Contact with the tension cam 137 is maintained by the tension arm return spring 146 coupled between the tension arm and the frame of the machine 10, or a secure location on the feed/tension unit 13 regardless of the strap tension applied. As shown in the cam timing diagram of FIG. 11, after the tension arm 138 has traveled fill stroke, it dwells for a short time in the fully extended position (FIG. 7A) allowing the left hand gripper 149 (FIG. 9C) to secure the strap 20 prior to releasing strap tension. The sealing head 16 continues to rotate and the tension arm 138 returns to its home position, releasing he strap tension prior to the cutting operation, as described below.

In an alternative embodiment to the pneumatic cylinder 190, shown in FIGS. 6D–6F and 7D–7F, a spring-loaded secondary tension unit and electrically controlled inhibit system can be employed. The alternative embodiment is substantially similar to the previously described embodiment, and only significant differences in operation or construction are described in detail. For example, a gripper holder 140" is pivotally received at the one end of the gripper linkage 140', where the gripper holder receives the strap gripper 140 therein. In the home position of the tension arm 138 (FIG. 7F), the tension arm is downwardly displaced, which similarly downwardly displaces the actuating arm 144', which is pivotally coupled at its free end to the tension arm. In the high tension position, however, (FIG. 7D), the tension arm 138, actuating arm 144', gripper 140, gripper holder 140", and gripper linkage 140' are displaced upwardly, to cause the first end of the gripper shaft to slide against an underside of the guide block 139''' and pivot downwardly to force the strap gripper 140 upwardly against the strap and underside of the guide block. The gripper spring 145 is coupled between a stationary frame member 145' and the actuating arm 144'.

The force set point of a spring 142 is mechanically adjustable by the operator for the particular product being strapped. An adjustment knob 172, which operates a tension adjustment linkage 173, is provided on the exterior of the machine for easy access. A pivot assembly 182 receives a first end of the tension spring 142, and is pivotally retained at the free end of the tension arm 138. A shaft or bolt 183 extends through the free end of the tension spring 142, and both the spring and bolt are positioned within a spring tube 142'. An end of the bolt 183 rests against an upper first end of a pivotally secured tension adjustment arm 180. A first end of a rod 181 is coupled through a linkage 181' to a roller 180'. The roller 180' rests on an upper edge of the adjustment arm 180, opposite the bolt 183 and pivot point of the adjustment arm. A free end of the rod 181 is selectively, manually positionable by rotating the tension knob 172, which in turn drives a threaded linkage 172' coupled to the free end of the rod 181. When the operator rotates the knob 172, the threaded linkage 172', a portion of which is coupled to the frame of the machine 10, similarly rotates to pivot the rod 181 and cause the roller 180' to move from a high force or tension position (shown in FIG. 6F) to a low tension position which is proximate to the pivot point.

An inhibit solenoid 141 couples through a pivotal linkage mechanism 143' to a first end of an inhibit lever 143. A free end of the inhibit lever 143 rests against an upper surface of the actuating arm 144' of the gripper actuator linkage 144. As a result, when the control system 200 supplies an inhibit signal to the solenoid 141, it distends to cause the inhibit lever 143 to pivot to displace downwardly the arm 144', and thereby inhibit the gripper linkage 140' and strap gripper 140 to move upwardly against the strap, despite movement of the tension arm 138.

Figure 7B:
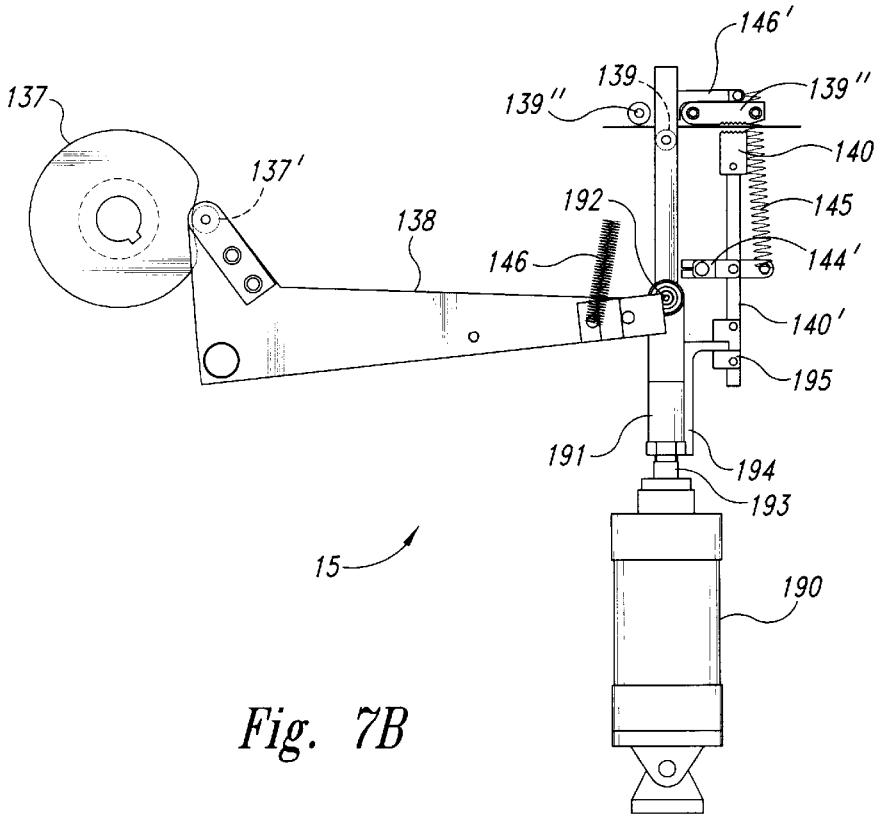
FIG. 7B is a front elevational view of a portion of the secondary tension unit of FIG. 6A showing a high tensioning disabled position.
Figure 7C:
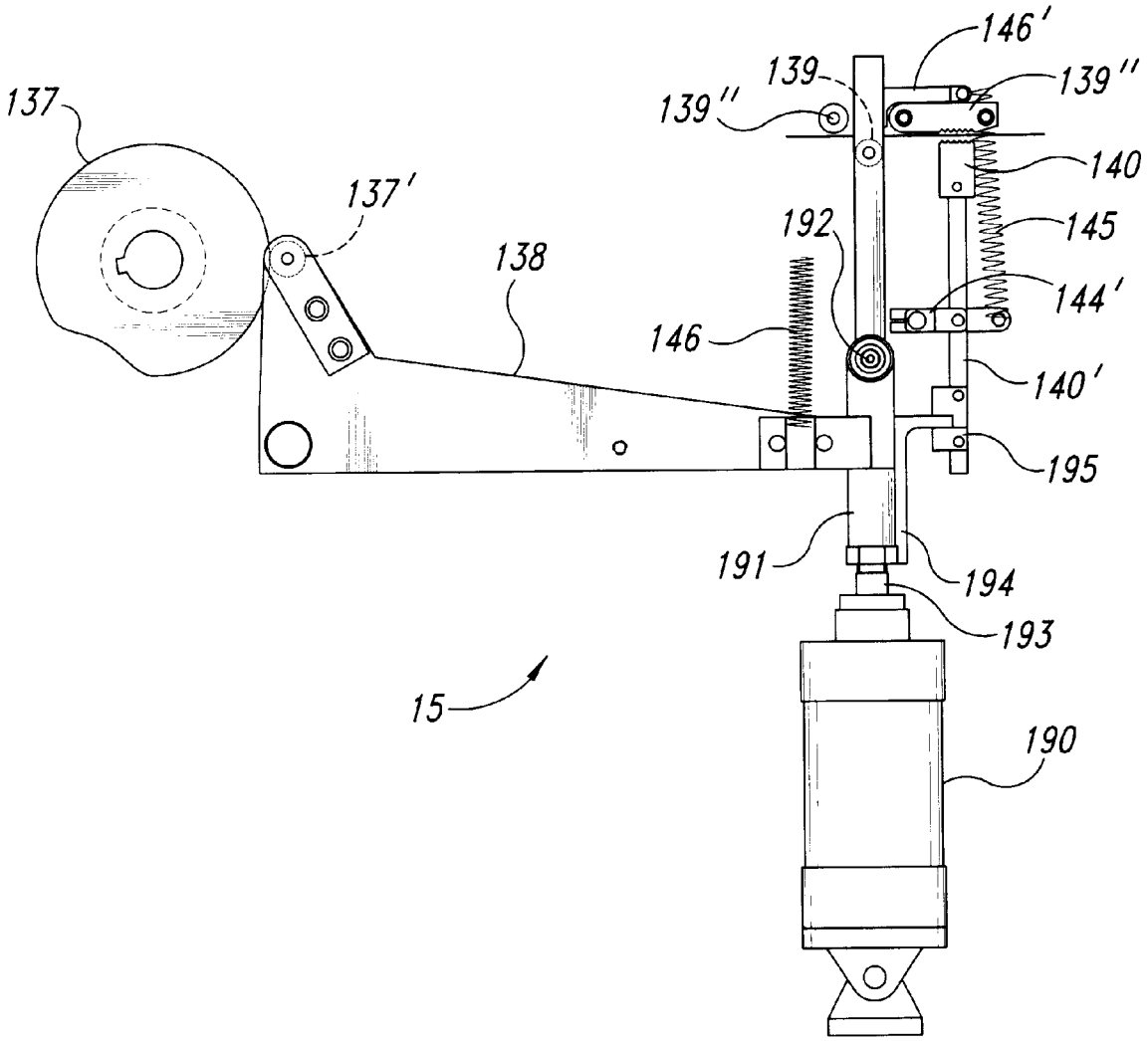
FIG. 7C is a front elevational view of a portion of the secondary tension unit of FIG. 6A showing a home position.
Figure 7D:
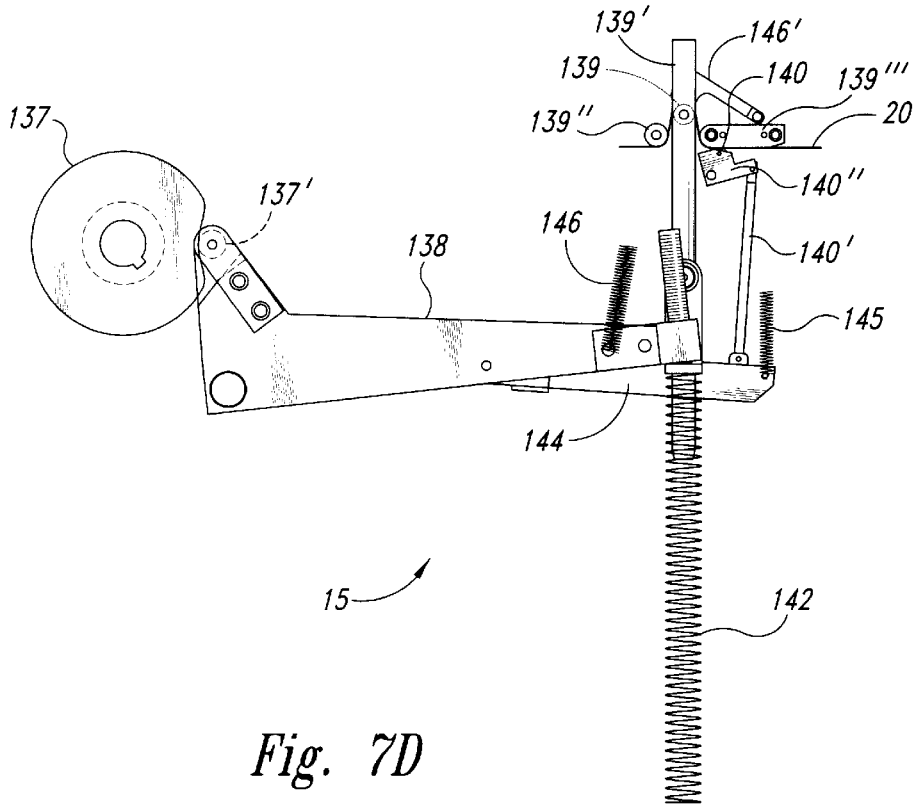
FIG. 7D is a front elevational view of a portion of the alternative embodiment of the secondary tension unit of FIG. 6D showing the high tension position.

Secondary tension is often inhibited where the high strap tension produced by the secondary tension unit 15 will damage the package being strapped. This mode is either selected manually via the operator touchscreen, or automatically by package height detectors. In the automatic mode, the control system 200 can compare the height signal for a given package to a threshold, and if the height signal is below the threshold, the control system provides the inhibit signal to the pneumatic cylinder 190 or solenoid 141. As noted above, secondary tension is disabled by the inhibit signal. In this disabled mode, the tension arm 138 travels through its normal path, however, the tension unit strap gripper 140 is disabled by drawing down the gripper linkage 140'. As shown in FIG. 7B, the pneumatic cylinder 190 in the first embodiment retracts the cylinder rod 193 to draw the cylinder eye 191, L-shaped bracket 194 and L-shaped block 195 downward and prevent the gripper linkage 140' from applying upward force to the strap gripper 140.

Figure 7E:
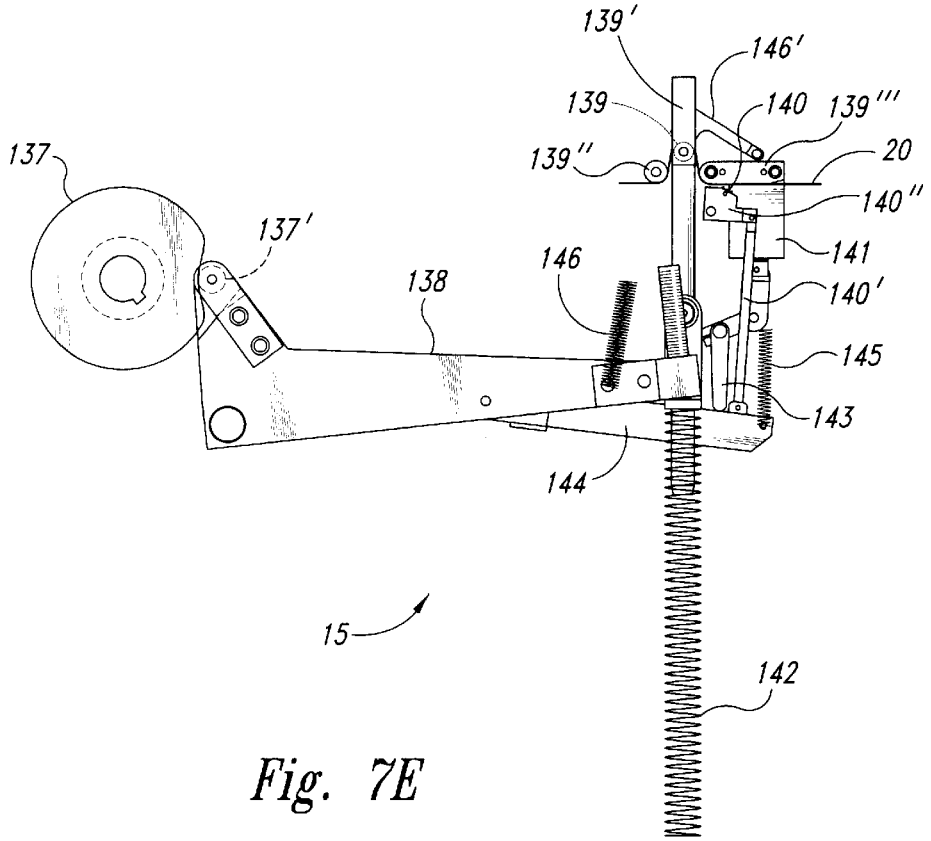
FIG. 7E is a front elevational view of a portion of the alternative embodiment of the secondary tension unit of FIG. 6D showing the high tensioning disabled position.
Figure 7F:
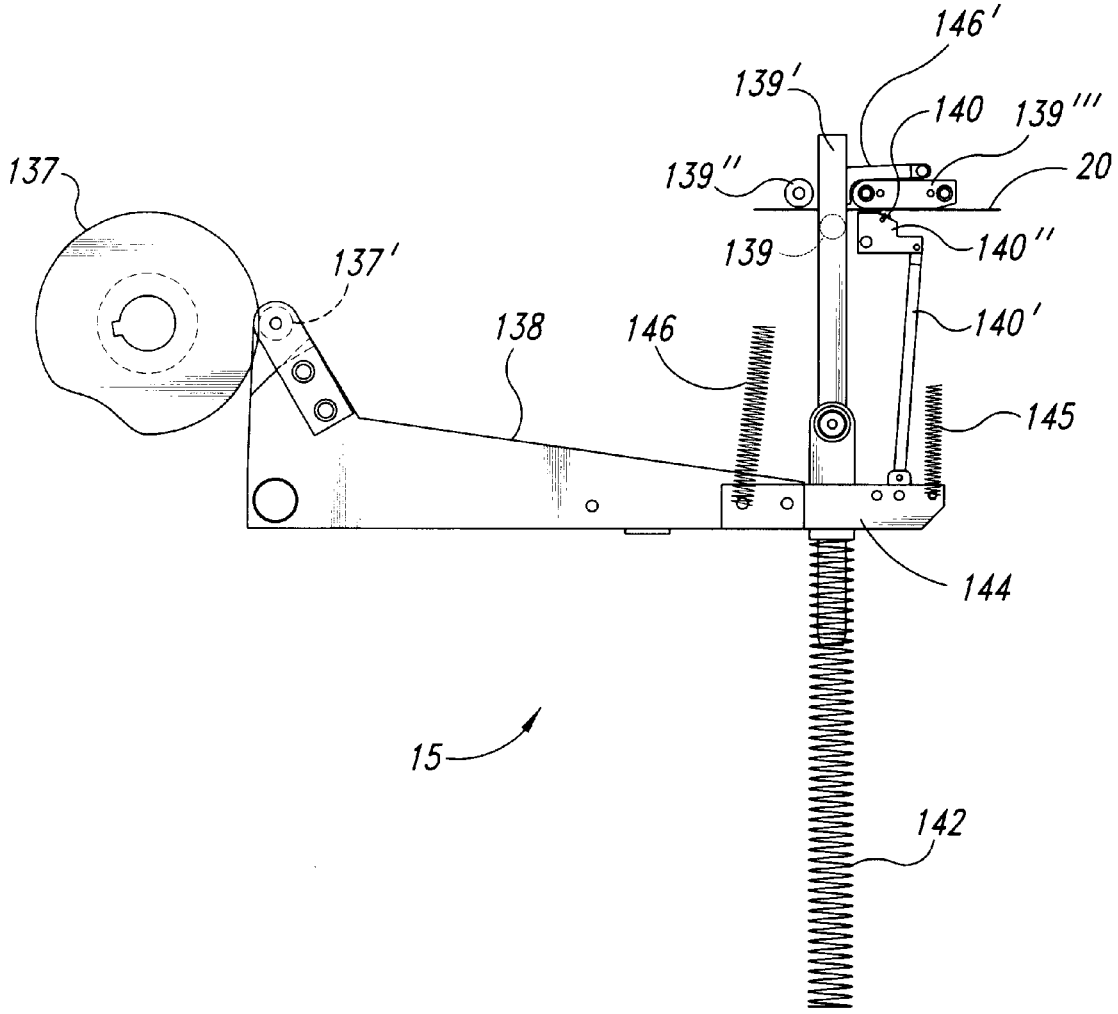
FIG. 7F is a front elevational view of a portion of the alternative embodiment of the secondary tension unit of FIG. 6D showing the home position.

The alternative embodiment operates similarly. As shown in FIG. 7E, the solenoid 141 actuates the inhibit lever 143, preventing the actuating arm 144, pivotally mounted on the tension arm 138, from applying upward force to the strap gripper 140. When the control system 200 provides the inhibit signal to the solenoid 141, the solenoid pivots the inhibit lever 143 downward to prohibit the arm 144 from moving upward, thereby disabling the strap gripper 140.

With either embodiment, the tension arm 138 still moves upwardly, under the compression force of the pneumatic cylinder 190 or spring 142 and the tension force of springs 146 when the cam 147 rotates to the high tension position. As a result, the roller lever 139'and thus the roller 139, still moves upwardly as the tension arm 138 similarly pivots upwardly. A short section of strap taken up by the tension roller 139 is drawn out of the accumulator 12 (rather than from around the package) when the tension roller moves upward. Consequently, the movement of the secondary tension arm 138 has no effect on the strap tension around the package. When the feeding cycle begins, the short section of strap left by the secondary tension roller 139 is easily pulled out and becomes part of the strap fed around the track guide 132 for the next strapping cycle.

Sealing Head Unit

Figure 10A:
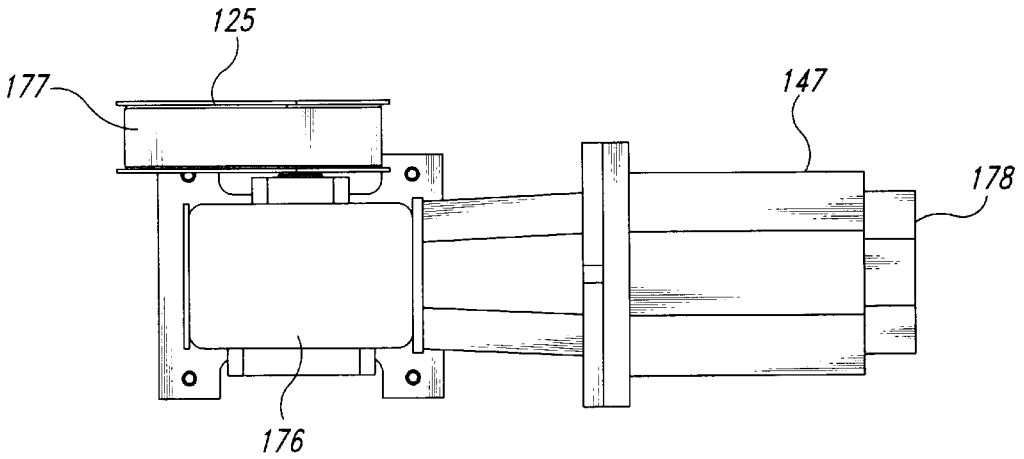
FIG. 10A is a top plan view of a main drive system for the strapping device of FIG. 1.
Figure 10B:
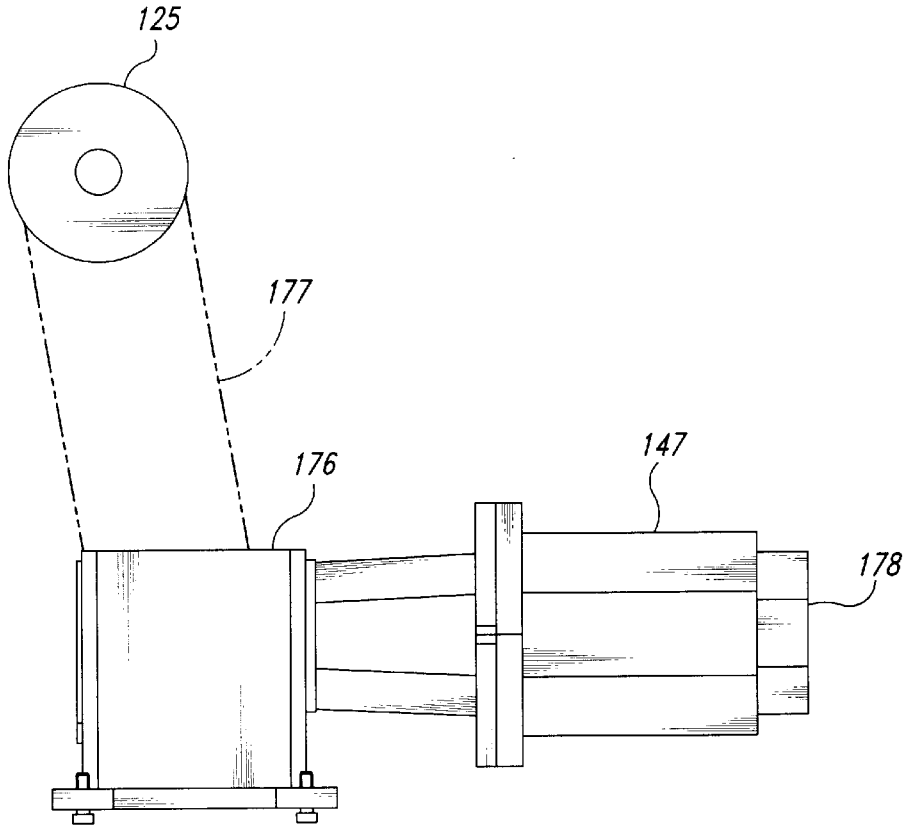
FIG. 10B is a front elevational view of the main drive of FIG. 10A.

Referring to FIGS. 9A–9C, the sealing head 16 performs the cutting and sealing operations in the strapping cycle. The sealing head 16 employs a brushless DC servo motor 147, which through a main drive reducer 176 and drive belt 177, rotates a sealing head mainshaft 125 (FIG. 10). The rotation of the mainshaft 125, and thus the various cams of sealing head 16, is monitored by the control system 200 by means of a main drive digital encoder 178, a home position proximity switch 170 and proximity switch pickup 171, which are all electrically coupled to the control system. This encoder 178 and proximity switch 170 information is monitored by the control system to provide closed loop sealing head control, as explained below. The sealing head essentially comprises: (1) main shaft mounted cams, (2) right and left hand rippers 148 and 149 respectively, (3) the heater blade 150, (4) the press platen 152, and (5) the cover slide 153.

Figure 11:
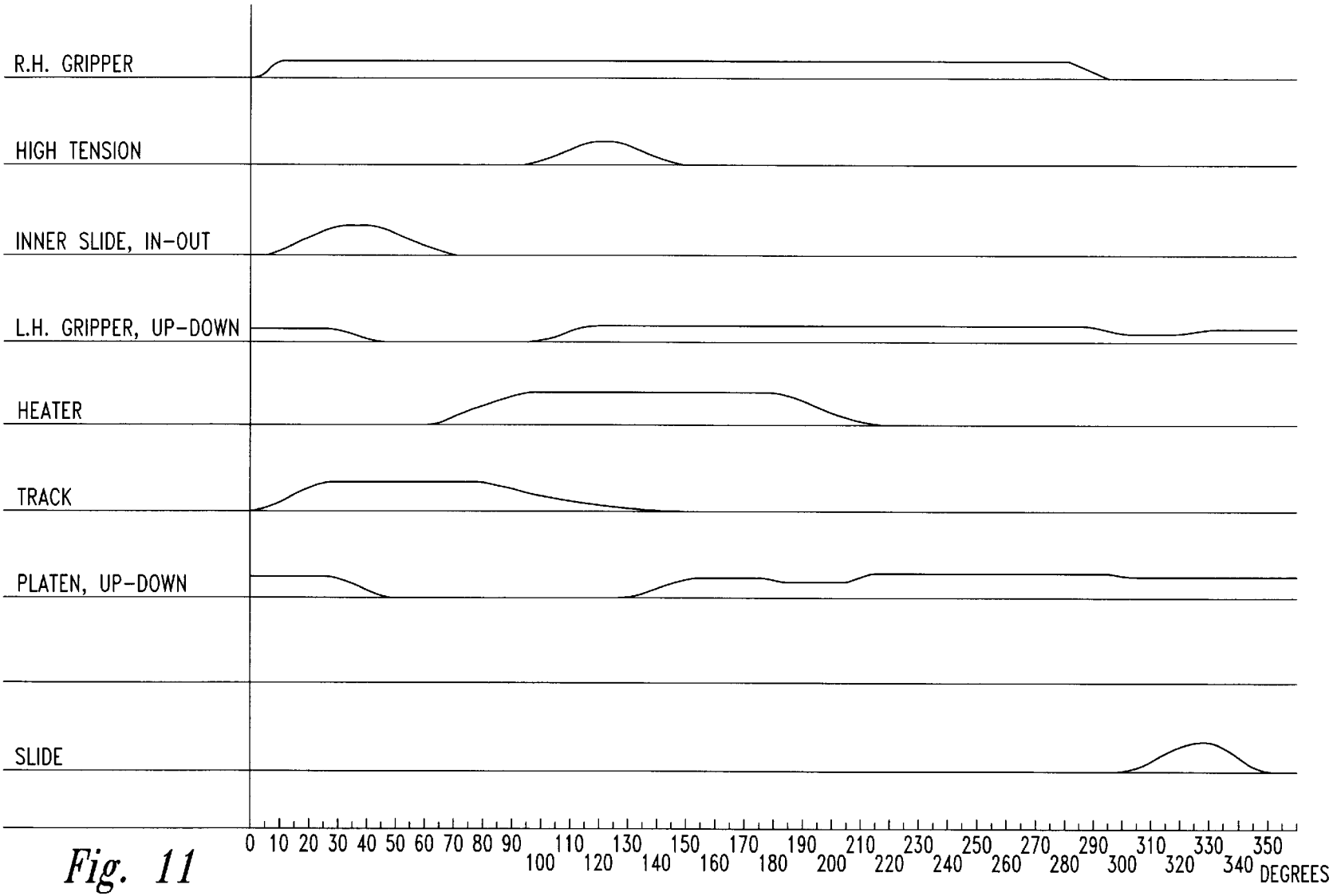
FIG. 11 is a schematic cam timing sequence.

The sealing head cams are keyed to the main shaft to ensure that the relative cam positions are maintained. As the main shaft or sealing head 16 rotates, the cams operate and position the various mechanisms associated with the strap sealing operation. The cam timing diagram of FIG. 11 illustrates the positions of the various cams, described below, and their resulting actuation of grippers, heating blade, and other elements of the sealing head 16.

The right and left hand grippers 148 and 149 are equipped with a series of teeth (shown in FIG. 9A) and are operated by right hand and left hand gripper cams 157 and 158 respectively. The right and left hand grippers 148 and 149 secure the strap 20 during the cutting and sealing operation. In addition, the right hand gripper 148 is used to secure the free end of the strap during the primary and secondary tensioning sequences.

A heater cam 156 actuates the heater blade 150, where the blade is used to melt the surface of the overlapping strap sections which will form the seal. The control system 200 controls the heater blade temperature by a low voltage, high amperage PWM circuit 216 (FIG. 3) energized when the machine power is on. The control system 200 modulates the temperature of the heater blade by adjusting the frequency or length of the pulses supplied to the PWM circuit 216, as discussed herein.

A press platen 152, with its integrated strap cutter 154, is used to cut the free end of the strap from the supply and to press the strap ends, melted by the heater blade 150, together to form the seal. The cover slide 153 provides the surface that the press platen 152 bears against for the sealing operation. Additional details regarding the general operation of the sealing head can be found in U.S. Pat. No. 4,120,239, incorporated herein by reference.

In operation, an initial rotation of the sealing head causes the right hand gripper cam 157 and right hand gripper follower 161 to allow the right hand gripper 148 to slide upwardly so that the gripper teeth of the right hand gripper engage the free end of the strap and retain it securely against corresponding teeth (not shown) on the underside of the cover slide 153. The sealing head mainshaft 125 continues to rotate and opens the strap track guide 132. As the track guide 132 opens, the strap is stripped from the track guide 132 by the stripper pins 136 located in each track corner. While the track is being opened, a slide cam 159 retracts an inner slide 155 and moves the press platen 152 and left hand gripper 149 away from the front of the sealing head 16. During the retracting of the inner slide 155, the press platen and left hand gripper cams 164 and 158 cause the press platen 152 and the left hand gripper 149 (by means of left hand gripper follower 149') to drop down below a level of both the upper and lower strap sections. With the free end of the strap still retained by the right hand gripper 148 and the strap loop now free from the track guide 132, the primary tension sequence (described above) begins. The sealing head main shaft 125 continues to rotate and after the primary tensions sequence has been completed, the tension cam 137 rotates to its high tension position and the secondary tension sequence begins as described above.

After the secondary tension sequence has been completed, the sealing head 16 continues to rotate and the heater cam 156 actuates the heater blade 150 to insert the blade between the upper and lower strap sections. During this time, the slide cam 159 moves the inner slide 155 again to the front of the sealing head 16, placing the press platen 152 and left hand gripper 149 under the strap sections in preparation for the sealing sequence. Next, the left hand gripper cam 158, through the left hand gripper follower 149', actuates the left hand gripper 149 to its raised position to grip the left end of the strap loop. After the strap has been secured by the left and right hand grippers 148 and 149, a press platen cam 164 actuates the press platen 152 to its raised heat position to force the overlapping strap sections into the heater blade 150 for the heating cycle.

During, this travel into the heat position, the cutter 154 mounted on the press platen 152, severs the strap from the supply using, a shearing, action between the cutter 154 and the right hand gripper face. The press platen 152 continues to travel upward into the heat position and forces the upper and lower strap ends into the heater blade 150. The strap ends are held in contact with the heater blade 150 for a period determined by the heater cam dwell and the sealing head 16 rotational speed. See FIG. 11. After this dwell in the heat position, the sealing head 16 continues to rotate, the press platen 152 drops slightly from the sealing area, thereby allowing, the heater blade 150 to be withdrawn based on the heater cam position. After the heater blade 150 has been withdrawn from the seal area, the press platen 152 again rises to force tile melted strap ends together to seal the strap.

As shown in FIG. 11, the sealing position of the press platen 152 is slightly higher than the heating position to account for the heater blade thickness. The press platen 152 maintains this position throughout the sealing cycle as the sealing head 16 continues to rotate. During the sealing operation, the strap path through the sealing head 16 is aligned such that the feed cycle, described above, can begin. The sealing head 16 continues to rotate to the end of the sealing cycle when the right and left hand grippers 148 and 149 and the press platen 152 drop slightly to release the upward load force on the underside of the cover slide 153. Next, the slide cam 159 actuates the cover slide 153 to open it, release the strap and closes again to start the next cycle. After the cover slide 153 closes, the strap concurrently being fed approaches the sealing head 16 to complete the feed. As the strap end enters the sealing head 16, the control feed/tension system 200 causes the motor 126 to decelerate to a predetermined and controlled stop just past the press platen. The strapping cycle is now complete and is ready for another cycle.

Control System and Operational Routines

Referring to FIG. 3, the control system 200 is shown in detail. As is known, mechanical machines are typically designed to apply a particular force over a particular duration. A great benefit achieved by the control system 200 is that forces and their application time are programmable. This control allows the machine to adapt and perform to specifications and requirements yet unknown. In addition, the substantial cost savings achieved by combining the functions of a programmable controller with the servo control make this machine concept feasible. The control system 200 essentially comprises: (1) a microprocessor 202. (2) a non-volatile flash memory 204, (3) RAM memory 206, (4) supervisory circuits 208, (5) digital inputs and outputs 210 and 212, (6) analog inputs and outputs 214 and 216, and (7) four special purpose microcontrollers 218 which control the servo motors. The control system also includes a clock circuit 220 that includes a real time clock and two timers, two encoder signal inputs 222, and three bi-directional serial ports 224. The various components 204–224 are coupled to the microprocessor 202 by means of a bus 226.

The microprocessor 202 used is preferably the 80C196NP manufactured by Intel Corporation. The 80C196NT microprocessor currently provides: (1) 25 MHz operation, (2) 1000 bytes of register , (3) register-register architecture, (4) 32 I/O port pins, (5) 16 prioritized interrupt sources, (6) 4 external interrupt pins and non-maskable interrupt ("NMI") pin, (7) 2 flexible 16-bit timer/counters with quadrature counting capability, (8) 3 pulse-width modulated (PWM) outputs with high drive capability, (9) full-duplex serial port with dedicated baud-rate generator, (10) peripheral transaction server (PTS), and (11) an event processor array (EPA) with 4 high-speed capture/compare channels. The EPA is used to generate separate pulse width modulated signals controlling the strap pinch force and heater blade temperature, as described herein. The PTS is used to provide background counting and timing functions to appropriately time certain operations during each strapping cycle.

The non-volatile flash memory 204 can be re-programmed by the processor. The flash memory preferably is preprogrammed to contain a routine 300 that the microprocessor executes to perform the various operations described herein. The routine 300 is described in detail below with respect to the flowcharts of FIGS. 12A–12D. Importantly, by employing flash memory, the routine can be altered in the control system without the need to change component parts.

The supervisory circuits 208 provide a conventional watchdog timer and a conventional power fail detection circuit. The watchdog timer interrupts the processor 202 if the program does not periodically poll and reset the timer after a preselected time period. If the watchdog timer times out, then the watchdog timer will reset the processor, typically when a program or processor failure has occurred. The power fail detection allows the control system to detect a power failure and shut down the machine in an orderly fashion (e.g., power down the heater blade 150).

The control system 200 preferably employs 32 digital inputs, 24 digital outputs, four analog inputs, four analog outputs, and two pulse width modulated outputs. The digital inputs and outputs 210 and 212 are conditioned (filtered) and optically isolated from the controller board using known opto-electric isolation circuits (not shown). The optical isolation limits voltage spikes and electrical noise often occurring in industrial environments. The strap exhaust switch 112, low strap sensor 26 hall effect sensor 123, proximity sensors 130, strap sensor 166 and home position proximity switch 170 are coupled to the digital inputs 210. The coil brakes 110, accumulator door solenoid 121, and the inhibit solenoid 141 are coupled to the digital outputs 212. The main drive encoder 178 and feed/tension encoder 179 are coupled to the two inputs 222. The analog inputs 216 allow the controller board to use a wide variety of analog sensors such as photoelectric and ultrasonic measuring devices for applications having special requirements.

The bi-directional serial ports 274 allow the control system 200 to commnunicate with external equipment. For example, one of the control ports provides display information to the operator over a conventional display device, such as a touch sensitive LCD screen. A second communication port can couple the control system 200 to external diagnostic equipment. The third communication port can be coupled to a modem so that information can be exchanged between the control system and a remote location over telecommunication lines. Additionally, the control system 200 can be reprogrammed through one of the communication ports 224, by reprogramming the flash memory 204. While not shown, the control system 200 can also include amplifiers and filter circuits that amplify or condition the signals input to and output from the control system 200. For example, an amplifier can be employed between the PWM outputs 216 and the heater blade 150 to provide a high current signal to the heater blade.

The four microcontrollers 218 preferably are LM628 Motion Control chips manufactured National Semiconductor Corporation, which essentially are dedicated microprocessors. The microcontrollers 218 therefore responds to high level commands to control the servo motors. The control program or routine 300 (described below) determines the number of rotations, acceleration rate, and velocity. This information is transferred to the microcontrollers 218 which compute and execute a trapezoidal motion profile. As is known, a trapezoidal motion profile determines an initial increase in velocity to a constant terminal velocity, and thereafter a decrease in velocity for the servo motors employed by the machine 10. The microcontrollers 218 receive motor position feedback from the motor mounted digital encoders 178 and 179. The microcontrollers 218 then signal external power amplifiers (not shown) to apply the proper voltage and current to control motor operation. The microcontrollers 218 compare the current motor position with the desired position and then update the drive signal more than 3,000 times per second.

Figure 12A:
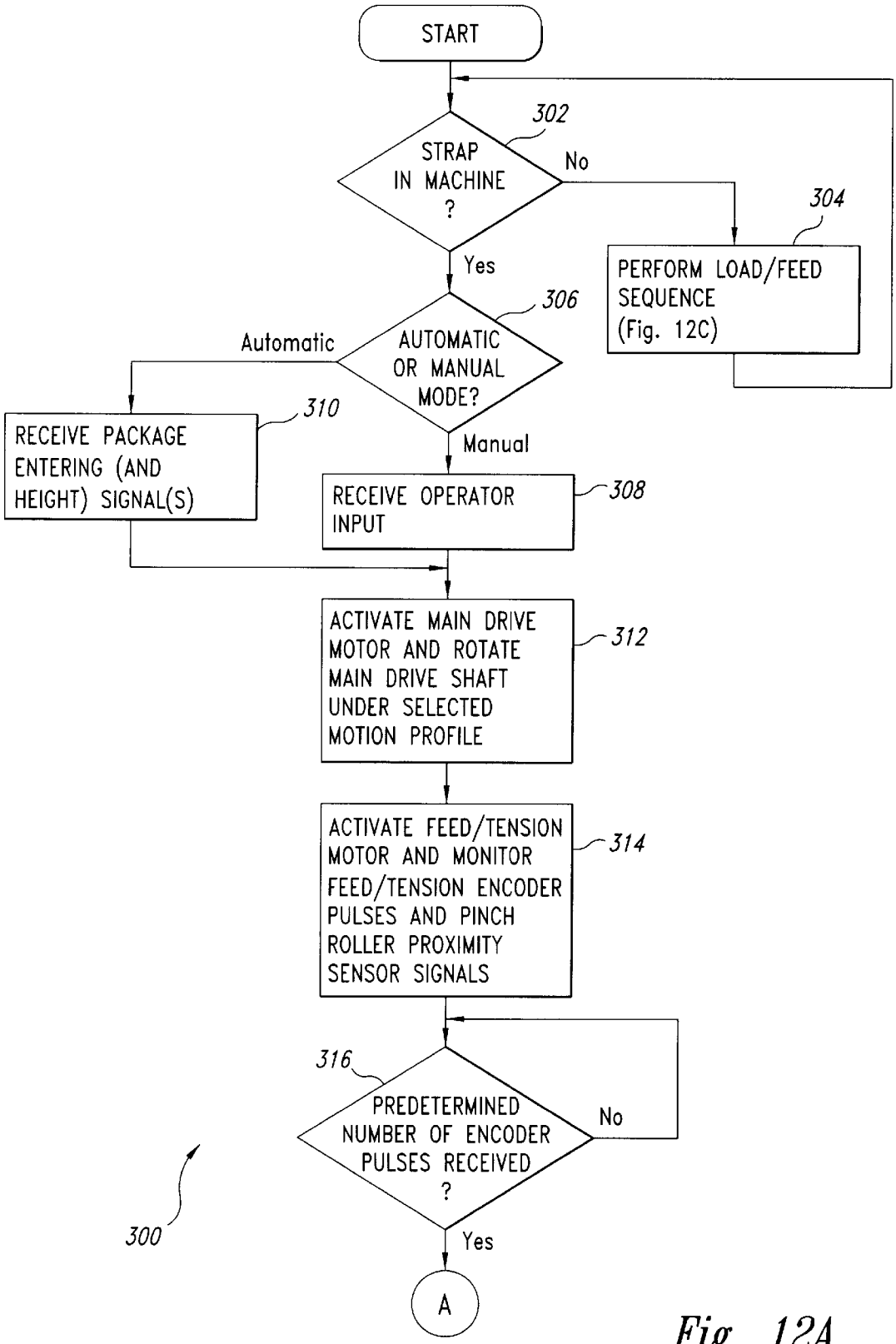
FIGS. 12A–12B are flowchart diagrams that together show the steps of a basic, exemplary routine performed by the control system of FIG. 3.
Figure 12B:
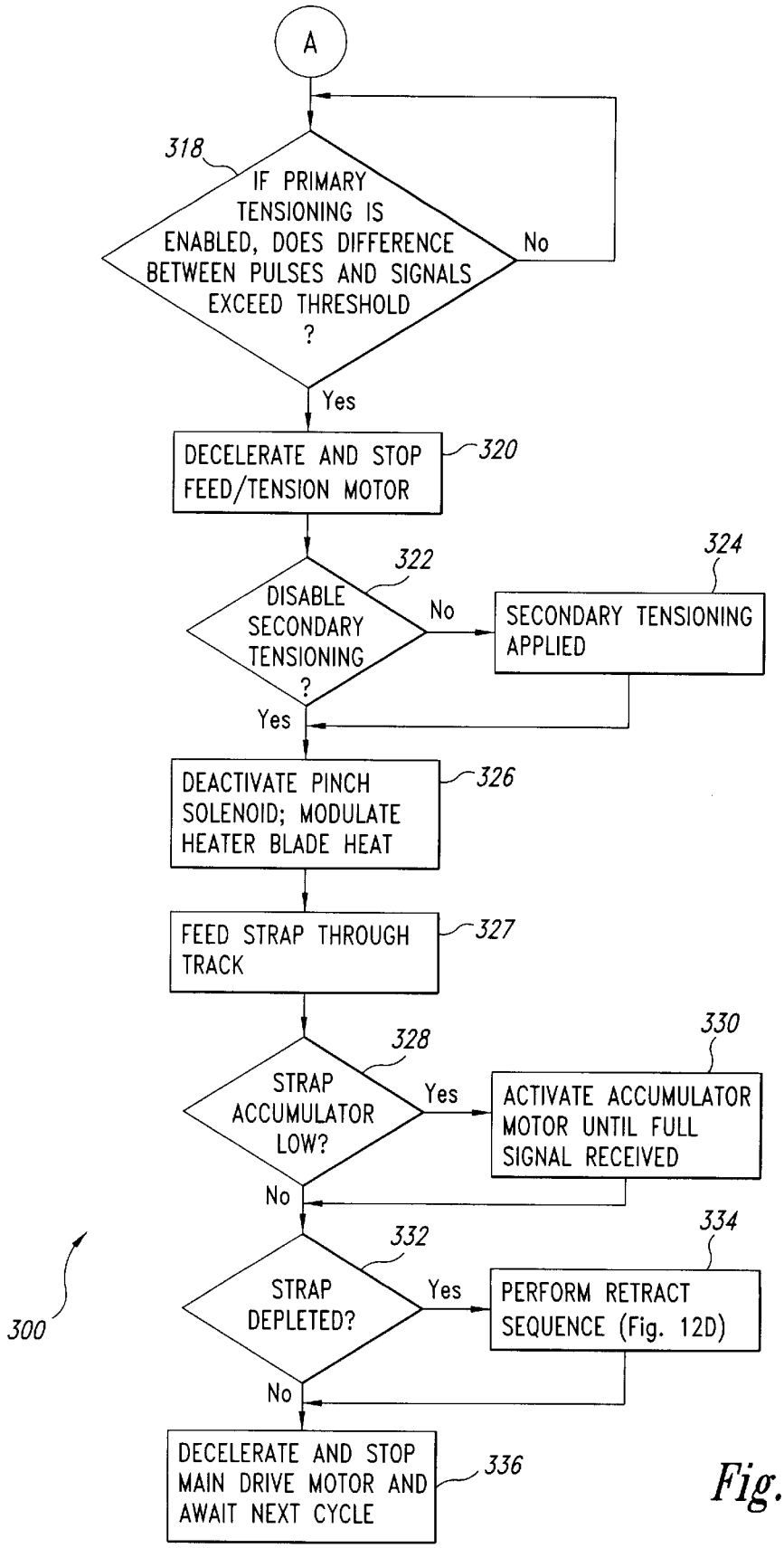

Referring now to the flowchart of FIGS. 12A–12B, the overall operation of the control system 200 with respect to the machine 10 will now be described. In order to begin a strapping cycle, the machine 10 must be loaded with the strapping material. 20 as described previously. Therefore, in step 302, the processor 202 determines whether there is tape material 20 in the machine 10 by determining if the strap sensor 166 provides a strap present signal. If no strap is present, then in step 304, the processor 202 performs the load sequence, described below with respect to FIG. 12C.

If there is strap in the machine 10, then in step 306, the processor 202 determines whether the machine is either in the manual or automatic mode. The strapping cycle is started either by the operator pressing the start button in the manual mode under step 308 or by the package entering signal in the automatic mode (under step 310). In step 310, the processor 202 also can receive height signals from a height sensor or operator selection to determine if primary and/or secondary tensioning is to be applied to the particular package.

In response to either a start signal initiated by the operator, or an automatic start signal due to a package entering the track 14, the microprocessor 202 in step 312 activates the main drive servo motor 147 on the sealing head drive. The servo motor 147 begins to rotate the sealing head 16 according to a predetermined move sequence controlling acceleration and terminal velocity. In step 312, the processor 202 and one of the microcontrollers 218 control the servo motor 147 according to a predetermined motion profile. A typical strapping cycle includes not only the steps under the routine 300 of FIGS. 12A–12D, which are performed by the control system 200 of FIG. 3, but also the various actuations of the left and right hand grippers, slide and platen movement, etc., under the timing diagram of 11, which are performed by the sealing head 16. To provide a full understanding of the operation of the machine 10, the steps of the routine 300 under FIGS. 12A–12D are described below in conjunction with the actuations performed by the sealing head 16 under the cam timing diagram of FIG. 11. Therefore, as the sealing head 16 begins to rotate, the right hand gripper cam timing profile allows the right hand gripper follower 161 to release the gripper spring 162, causing the right hand gripper 148 to rise into position to grip the free end of the strap between the right hand gripper 148 and the cover slide 153. Also during this first sequence, the slide cam 159 pulls the inner slide 155 away from the sealing area in preparation for the tensioning sequence.

During the movement of the inner slide 155, the previously fed strap is stripped from the press platen 152 and left hand gripper 149 slots by the center stripper 163. As the press platen 152 and left hand gripper 149 are pulled back, their respective cams cause them to drop down below the level of the strap being stripped away. This downward movement allows the press platen 152 and left hand gripper 149 to return underneath the two strap sections at the beginning of the sealing sequence.

Concurrently, the track cam 131 opens the track guide 132 and the strap is stripped from the track guide 132 by the track cover 135 mounted stripper pins 136. After the track guide 132 has opened, the microprocessor 202, under step 314, activates the feed/tension servo motor 126. The servo motor 126 begins to rapidly retract the strap according to a predetermined move sequence controlling acceleration and terminal velocity. In step 314, the microprocessor 202 also monitors the tension encoder pulses from the feed/tension encoder 179, and the proximity sensor signals from the proximity sensors 130.

In step 316, the processor 202 determines if the number of encoder pulses received from the feed/tension encoder 179 equal a predetermined value. As noted above, under the loop size control mode, the processor 60 draws the strap 20 down to a predetermined loop size by monitoring the pulse signals from the reed/tension encoder 179 and/or proximity sensors 130. When the microprocessor receives a predetermined number of pulses, then in step 318 the processor determines if primary tensioning has been enabled. If so, then the processor 202 determines whether a difference between the signals from the feed/tension encoder 179 and the signals from the proximity sensors 130 exceed a predetermined threshold. As the strap contacts the package, slippage occurs between the feed/tension drive roller 127 and the solenoid 128 loaded pinch roller 129. This slippage or speed differential is detected by the processor 202 as it monitors the feed/tension encoder 179 and the proximity sensors 130 at the pinch roller 129. After a predetermined speed differential is detected, the processor 202 in step 320 issues a motor command to decelerate and maintain its position. Alternatively, the processor 202 can omit step 318. As a result, the servo motor 126 retracts the strap 20 by a predetermined amount, such as under the loop size control mode discussed above. Step 318 can be omitted when, for example, the size of the track 14 is small so as to provide a small loop of strap during each strapping cycle, when small bundles are strapped, etc.

During the primary tensioning, sequence, the sealing head 16 has continued to rotate and after a time, determined by the sealing head 16 rotational speed, the secondary tension cam 137 moves the tension arm 138 through its path allowing the pneumatic cylinder 190 or spring-loaded tension roller 139 to apply final tension to the strap. In step 322, the processor 202 determines if secondary tensioning needs to be disabled based on either an input from the bundle height sensor or operator input. If secondary tension needs to be disabled, the processor 202 provides an inhibit signal to the pneumatic cylinder 190 to prevent the cylinder rod 193 from extending during secondary tensioning. However, if secondary tensioning has not been disabled, then in step 324, as the tension arm 138 begins to travel upward, the strap gripper 140 secures the strap as the gripper arm 144 and tension arm 138 move upward. The strap gripper 140 contacts the strap and anchors it during the secondary tension process, insuring the strap is tensioned around the strap rather than being pulled from the accumulator 12. During the tensioning process, the sealing head 16 continues to rotate and the heater cam 156 inserts the heater blade 150 between the upper and lower strap sections in preparation for the sealing operation.

As the secondary tension sequence is completed, the sealing head 16 continues to rotate and returns the press platen 152 and left hand gripper 149 to a position in front of the sealing head 16, underneath the upper and lower strap sections. While the sealing head 16 continues to rotate, the left hand gripper cam 158 raises the left hand gripper 149 into position to anchor the strap against the cover slide 153. After both strap ends have been secured, the tension cam 137 releases the secondary tension arm 138 ensuring the strap is not cut under tension.

The sealing head 16 continues to rotate and the press platen cam 164 forces the press platen 152 upward to thereby force the strap ends into the heater blade 150. As the press platen 152 travels upward, the press platen mounted cutter 154 provides a shearing action against the right hand gripper face severing the strap. As the heater blade 150 contacts the strap ends to seal them, the processor 202 in step 326 can modulate the current applied to the heater blade 150 so that the blade provides sufficient heat to positively seal the strap ends, but not overheat them.

As the sealing head 16 continues to rotate, the press platen 152 continues to travel upward forcing the two strap sections into the heater blade 150 where they remain in contact for a period determined by the heater cam dwell. During this dwell, the strap sections in contact with the heater blade 150 are melted at the surface. Near the end of the dwell period, the press platen cam 164 causes the press platen 152 to drop slightly, allowing the heater cam 156 to withdraw the heater blade 150 from between the two strap sections.

After the heater blade 150 is clear of the sealing area, the press platen 152 again rises to press the two overlapping strap ends together to form the seal. The press platen cam 164 causes the press platen 152 to dwell in this position allowing the seal to cool. During this dwell period, a feed sequence for a succeeding strap cycle begins in step 327. To start the sequence, the processor 202 in step 327 issues a forward command to the feed/tension motor 126 to accelerate the motor to a terminal speed and push a predetermined amount of strap through the track guide 132 (the pinch solenoid 128 is engaged whenever power to the machine 10 is applied).

After the sealing process is complete, the left and right hand grippers and the press platen 152 drop down slightly, allowing the slide cam 159 to open the cover slide 153 and release the strap. The retained strap tension from the tensioning process causes the strap to be pulled upward and away from the sealing head 16. The slide cam 159 then returns the cover slide 153 to its closed/home position and the sealing head rotation stops. During the sealing sequence, the strap has continued to feed in step 327, thus preparing the machine 10 for the next strapping cycle. Shortly after the cover slide 153 reaches its closed/home position at the end of the strapping cycle, the free end of the strap again enters the sealing head 16 and stops just past the press platen 152.

In step 328, the processor 202 determines whether the strap accumulator 12 is low by monitoring the signals from the hall effect sensor 123. The determination as to whether the strap accumulator 12 is low is performed continuously, and independent of the strapping cycle discussed above. If the processor 202 determines from the signals from the hall effect sensor 123 that the accumulator has an insufficient amount of strap therein, then in step 330, the processor provides a forward command to the accumulator motor 122. In response thereto, the accumulator motor 122 pays off, strap from the primary or secondary dispenser 11 into the accumulator 12, until the processor 202 receives an accumulator full signal from the hall effect sensor 132 or strap depleted signal from the strap exhausted switch 112. In response thereto, the processor 202 deactivates the accumulator motor 122. In step 332, the processor 202 determines whether the strap 20 has been depleted by monitoring the strap exhausted switch 112. If the processor 202 detects a strap exhausted signal in step 332, then in step 334, the processor performs the strap retract sequence, described below with respect to FIG. 12D.

Figure 12C:
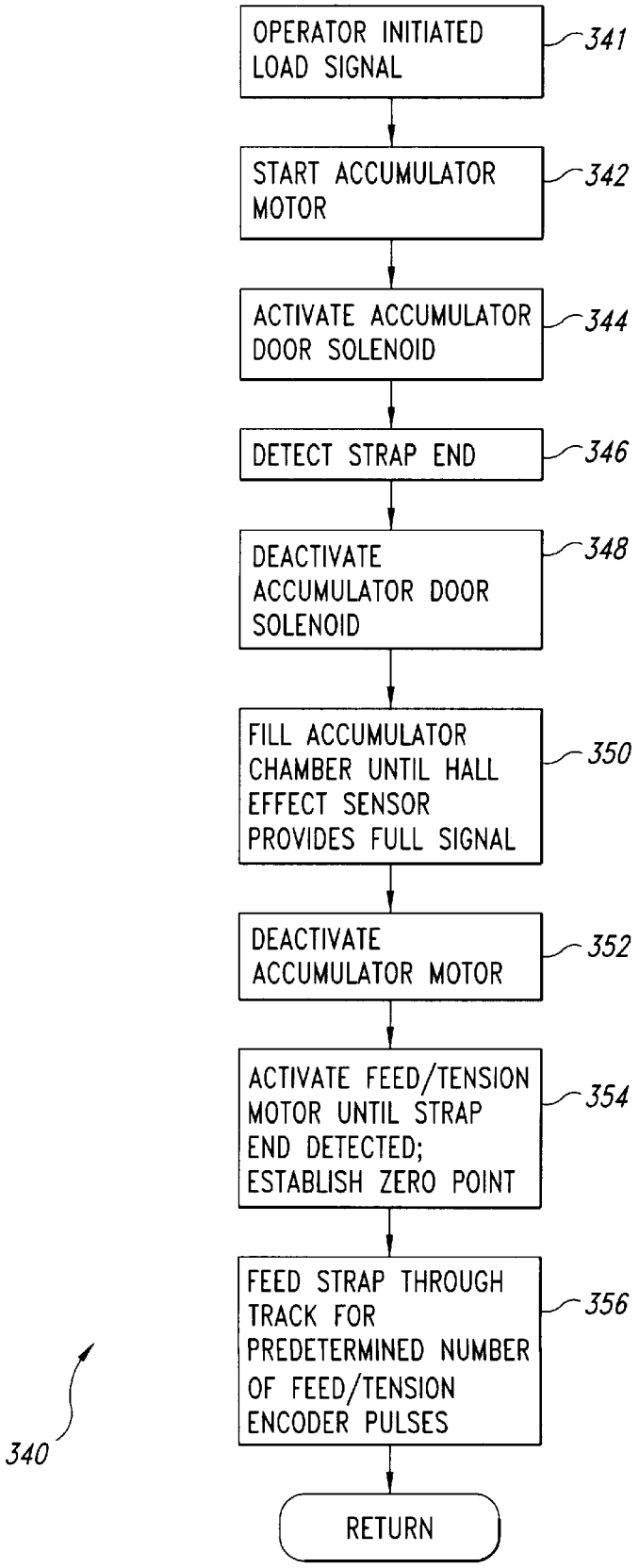
FIG. 12C is a flowchart diagram that shows the steps of a basic, exemplary load routine performed by the control system of FIG. 3.

Referring to FIG. 12C, an exemplary load/feed routine 340 begins in step 341 where the processor 202 receives a load initiation signal from the operator pressing a load push button (not shown). In step 342, the processor 202 provides a forward command to the accumulator motor 122 so that the pinch and drive rollers 114 and 115 rotate to provide strap into the accumulator 12. In step 344, the processor 202 activates the accumulator door solenoid 121 so that the strap is guided through the guide 30 in the accumulator door 119 into the feed/tension unit 13.

In step 346, the processor 202 detects the strap present signal from the strap sensor 166. Thereafter, in step 348, the processor 202 deactivates the accumulator door solenoid 121. In step 350, the accumulator motor 122 continues to force strap from the dispenser 11 into the accumulator 12 until the processor 202 receives a full signal from the hall effect sensor 123. Thereafter, in step 352, the processor 202 deactivates the accumulator motor 122. In step 354, the processor 202 provides a forward command to the feed/tension motor 126, at a slow speed, just until the processor receives the strap present signal from the strap sensor 166. In response thereto, the processor 202 establishes a zero point for the strap.

In step 356, the processor 202 performs the above described feed sequence for feeding strap through the track 14. In summary, the processor 202 feeds a predetermined amount of strap through the track 14 based on a predetermined number of encoder pulses from the feed/tension encoder 179. Thereafter, the processor 202 returns to the main routine 300.

Figure 12D:
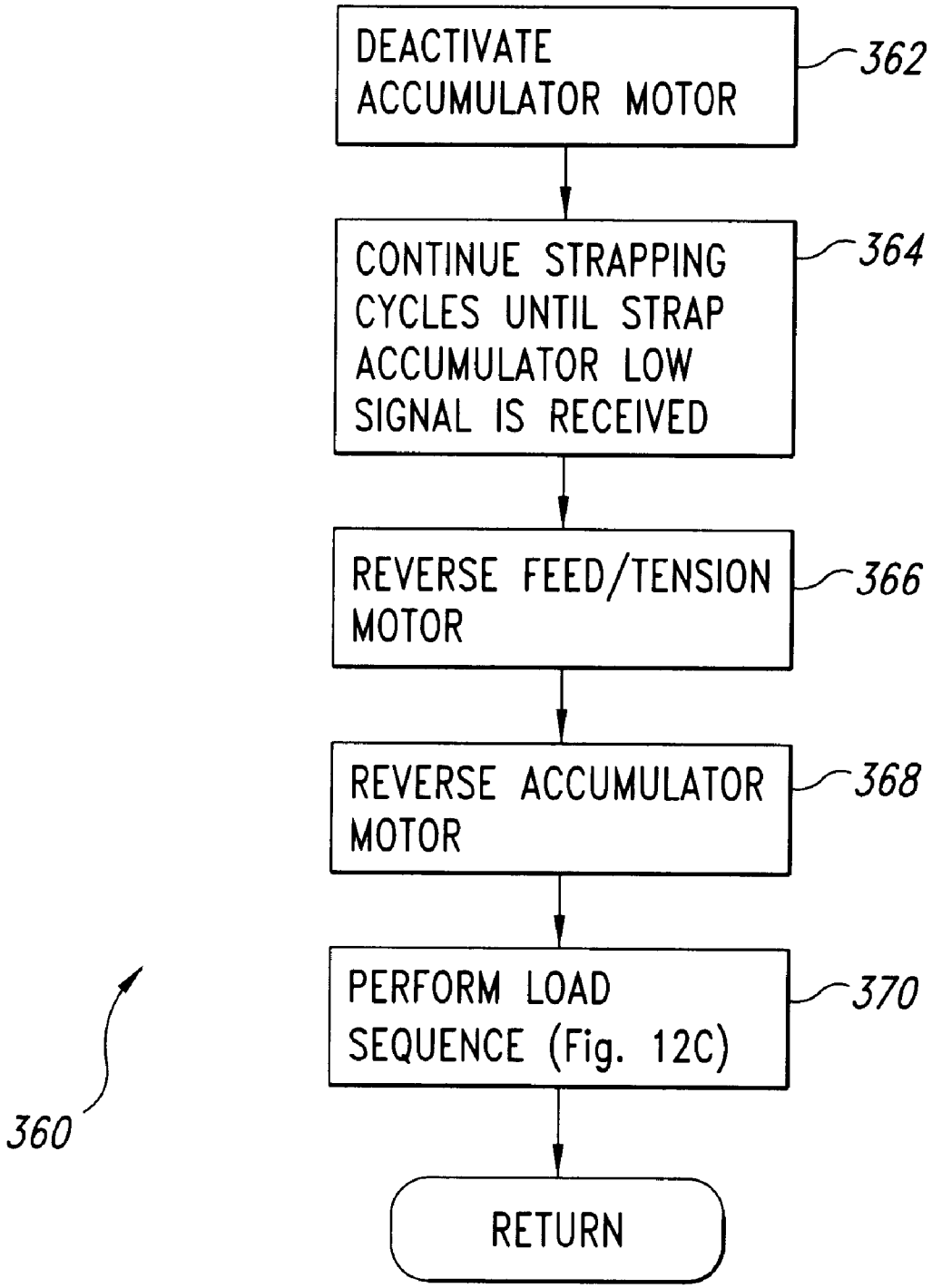
FIG. 12D is a flowchart diagram that shows the steps of a basic, exemplary strap retract routine performed by the control system of FIG. 3.

Referring to FIG. 12D, an exemplary strap retract routine 360 is shown. In step 362, the processor 202 deactivates the accumulator motor 122 preventing the remaining strap from being pulled into the accumulator. If the remaining strap is pulled completely into the accumulator, it generally cannot be automatically ejected. In step 364, the processor 202 causes the machine 10 to continue strapping cycles until the hall effect sensor 123 provides an appropriate signal to the processor that the accumulator is low (i.e., not full). In response thereto, in step 366, the processor 202 provides a reverse command to the feed/tension motor 126 and the accumulator motor 122, which causes it to retract any strap from the track 14 and the accumulator 12. The feed/tension motor 126 and accumulator motor 122 reverse concurrently to expedite the retract cycle. Thereafter, in step 368, the processor 202 provides a reverse command to the accumulator motor 122, causing it to eject the remaining portion of strap within the accumulator. In step 370, the processor 202 initiates the load routine 340 of FIG. 12C.

Although specific embodiments of, and examples for, the present invention have been described above for purposes of illustration, various modifications can be made without departing the spirit and scope of the invention, as will be evident by those skilled in the relevant art. For example, the machine 10 can include additional sensors and encoders to provide additional signals to control the application of strapping to bundles of various size and consistency. Additionally, all U.S. patents cited above are incorporated herein by reference as if set forth in their entirety. The teachings of the U.S. patents can be modified and employed by aspects of the present invention, based on the detailed description provided herein, as will be recognizable to those skilled in the relevant art. The teachings provided herein of the present invention can be applied to other bundling systems, riot necessarily those limited to bundling objects such as newspapers or magazines.

Furthermore, while the present invention as generally described as being applied to a strapping machine, the principles of the present invention can be applied to other machines for manipulating flexible tape-shaped material. These and other changes can be made to the invention in light of the above detailed description. In general, in the following claims, the terms used should not be construed to limit the invention to the specific embodiments disclosed in the specification and the claims, but should be construed to include all systems for manipulating tape-shaped material in accordance with the claims. Accordingly, the invention is not limited by the disclosure, but instead its scope is to be determined entirely from the following claims.

We claim:

1. In a bundling system for bundling one or more objects positioned within a track with tape shaped material, the bundling system having a dispenser of tape material, the track, a first motor driven pinch roller unit, and a motor driven tape material cutting and securing unit, a method of controlling the bundling system comprising the steps of:

driving the first pinch roller unit forward;

feeding the tape material about the track from the dispenser;

activating the cutting and securing unit to secure a free end of the tape material;

reversing the first pinch roller unit;

tensioning the tape material about the objects;

monitoring a position of the tape material;

halting the first pinch roller unit when a monitored position of the tape material has a predetermined relationship to a selected value;

fixedly securing the free end and an upstream portion of the tape material together; and cutting the upstream portion of the tape material from a remainder of the tape material.

2. The method of claim 1 wherein the bundling system includes a secondary tension unit, and wherein the method further includes the steps of:

determining that secondary tensioning is not to be applied to the objects; and deactivating the secondary tension unit so that secondary tensioning is not applied to the objects.

3. The method of claim 1 wherein the first pinch roller unit includes a drive roller and a pinch roller, and wherein the step of monitoring the position of the tape material includes the steps of:

monitoring position signals from the drive and pinch rollers; and determining a difference between the drive and pinch roller signals.

4. The method of claim 1 wherein the first pinch roller unit includes a drive roller and a pinch roller, and wherein the step of reversing the pinch roller unit includes the steps of:

monitoring pulse signals from one of the drive and pinch rollers; and reversing the pinch roller unit until the one of the drive and pinch rollers provides a selected number of pulse signals.

5. The method of claim 1 wherein the bundling system includes a tape material accumulating compartment having an accumulating compartment full sensor and a second motor driven pinch roller unit, and wherein the method further comprises the steps of:

receiving a compartment low signal from the accumulating compartment sensor driving the second pinch roller unit forward to feed tape material into the accumulating compartment;

monitor the accumulating compartment full sensor for a compartment full signal; and halting the second pinch roller unit when the compartment full signal is received.

6. The method of claim 5 wherein the accumulating compartment includes a selectively engageable tape material load guide, and wherein the method further comprises the steps:

engaging the load guide;

driving the second pinch roller unit forward to feed tape material through the load guide and into the first pinch roller unit;

detecting the free end of the strap; and disengaging the load guide.

7. The method of claim 6, further comprising the steps of:

driving the first pinch roller forward at a slow rate until the free end of the tape material is initially detected; and establishing a zero position location for the tape material.

8. The method of claim 5, further comprising the steps of:

detecting an end of the tape material on the dispenser: and reversing the first and second pinch rollers to eject a remaining portion of the tape material from the accumulating compartment.

9. In a bundling system for bundling one or more objects positioned within a track with tape shaped material, the bundling system having a dispenser of tape material, the track, a first motor driven pinch roller unit, and a motor driven tape material cutting and securing unit, a method of controlling the bundling system comprising the steps of:

driving the first pinch roller unit forward;

feeding the tape material about the track from the dispenser;

activating the cutting and securing unit to secure the free end of the tape material;

reversing the first pinch roller unit;

tensioning the tape material about the objects;

monitoring a feedback signal indicative of a slippage between the tape material and the first pinch roller unit;

halting the first pinch roller unit when the feedback signal has a predetermined relationship to a selected value;

fixedly securing the free end and an upstream portion of the tape material together; and cutting the upstream portion of the tape material from a remainder of the tape material.

10. The method of claim 9 wherein the monitoring a feedback signal indicative of a slippage between the tape material and the first pinch roller unit comprises monitoring a slippage signal during the feeding of the tape material about the track.

11. The method of claim 9 wherein the monitoring a feedback signal indicative of a slippage between the tape material and the first pinch roller unit comprises monitoring a slippage signal during the tensioning the tape material about the objects.

12. The method of claim 9, further comprising exerting a secondary tension in the tape material about the objects.

13. The method of claim 12 wherein the exerting a secondary tension in the tape material comprises displacing the tape material in a direction at least partially normal to a local feed direction of the tape material.

14. A method of bundling one or more objects positioned within a track of a bundling apparatus having a pinch roller unit, a cutting and securing unit, and a tensioning unit, the method comprising:

feeding a bundling material about the track using the pinch roller unit;

activating the cutting and securing unit to secure the free end of the bundling material;

reversing the pinch roller unit to exert a primary tension in the bundling material about the one or more objects;

monitoring a slippage signal indicative of a slippage of the bundling material with respect to the pinch roller unit;

halting the pinch roller unit when the slippage signal indicates a predetermined slippage value; and fixedly securing the free end and an upstream portion of the bundling material together.

15. The method of claim 14 wherein the monitoring a slippage signal indicative of a slippage of the bundling material comprises monitoring a ratio of a first revolution rate of a drive wheel and a second revolution rate of a pinch wheel.

16. The method of claim 14 wherein the monitoring a slippage signal indicative of a slippage of the bundling material comprises monitoring a slippage signal during the feeding of the bundling material about the track.

17. The method of claim 14 wherein the monitoring a slippage signal indicative of a slippage of the bundling material comprises monitoring a slippage signal during the reversing the pinch roller unit to exert a primary tension in the bundling material.

18. The method of claim 14, further comprising separating the upstream portion of the bundling material from a remainder of the bundling material.

19. The method of claim 14, further comprising opening the track to release the bundling material.

20. The method of claim 14, further comprising monitoring a feed-jam signal indicative of a jam of the bundling material during the feeding of the bundling material about the track.

21. The method of claim 20 wherein the monitoring a feed-jam signal indicative of a jam of the bundling material comprises monitoring a ratio of a first revolution rate of a drive wheel and a second revolution rate of a pinch wheel.

22. The method of claim 20, further comprising halting the feeding of the bundling material when the feed-jam signal indicates a jam of the bundling material.

23. The method of claim 14, further comprising exerting a secondary tension in the bundling material about the objects.

24. The method of claim 23 wherein the exerting a secondary tension in the bundling material comprises displacing the bundling material in a direction at least partially normal to a local feed direction of the bundling material.

25. A method of bundling one or more objects positioned within a track of a bundling apparatus, the method comprising:

feeding a bundling material about the track;

monitoring a first feedback signal indicative of a feed-jam of the bundling material;

securing the free end of the bundling material;

reversing the pinch roller unit to exert a primary tension in the bundling material about the one or more objects;

halting the pinch roller unit when the primary tension reaches a predetermined primary tension value; and joining the free end and an upstream portion of the bundling material together.

26. The method of claim 25, further comprising monitoring a tension signal indicative of the primary tension in the bundling material.

27. The method of claim 25 wherein monitoring a first feedback signal indicative of a feed-jam of the bundling material comprises monitoring a ratio of a first revolution rate of a drive wheel and a second revolution rate of a pinch wheel.

28. A method of bundling one or more objects positioned within a track of a bundling apparatus, the method comprising:

feeding a bundling material about the track;

securing the free end of the bundling material;

reversing the pinch roller unit to exert a primary tension in the bundling material about the one or more objects;

monitoring a tension signal indicative of the primary tension in the bundling material;

halting the pinch roller unit when the tension signal reaches a predetermined primary tension value; and joining the free end and an upstream portion of the bundling material together.

29. The method of claim 28 wherein monitoring a tension signal indicative of the primary tension in the bundling material comprises monitoring a ratio of a first revolution rate of a drive wheel and a second revolution rate of a pinch wheel.

30. The method of claim 28, further comprising monitoring a first feedback signal indicative of a feed-jam of the bundling material.

* * * * *